US009280137B2

(12) United States Patent
Tanaka

(10) Patent No.: US 9,280,137 B2
(45) Date of Patent: Mar. 8, 2016

(54) IMAGE FORMING APPARATUS WITH DEVELOPMENT CONTRAST CONTROL

(71) Applicant: CANON KABUSHIKI KAISHA, Tokyo (JP)

(72) Inventor: Shigeru Tanaka, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/834,637

(22) Filed: Mar. 15, 2013

(65) Prior Publication Data

US 2013/0287414 A1 Oct. 31, 2013

(30) Foreign Application Priority Data

Apr. 27, 2012 (JP) ..... 2012-103583

(51) Int. Cl.
*G03G 21/20* (2006.01)
*G03G 15/08* (2006.01)

(52) U.S. Cl.
CPC ..... *G03G 21/20* (2013.01); *G03G 15/0848* (2013.01); *G03G 15/0849* (2013.01); *G03G 21/203* (2013.01)

(58) Field of Classification Search
CPC . G03G 21/203; G03G 21/20; G03G 15/0848; G03G 15/0849
USPC ..... 399/44
See application file for complete search history.

(56) References Cited

U.S. PATENT DOCUMENTS

| | | | | |
|---|---|---|---|---|
| 8,224,195 | B2 * | 7/2012 | Zollner | G03G 15/0848 399/29 |
| 8,712,263 | B2 | 4/2014 | Tanaka | |
| 2009/0116858 | A1 * | 5/2009 | Tomita | 399/27 |
| 2010/0239290 | A1 * | 9/2010 | Ryu | 399/53 |
| 2011/0280600 | A1 * | 11/2011 | Suzuki | 399/44 |
| 2011/0305468 | A1 * | 12/2011 | Fujiwara | 399/27 |
| 2012/0134690 | A1 | 5/2012 | Tanaka | |
| 2013/0183049 | A1 | 7/2013 | Tanaka | |
| 2014/0199088 | A1 | 7/2014 | Tanaka | |

FOREIGN PATENT DOCUMENTS

| | | | |
|---|---|---|---|
| JP | 9-134066 | A | 5/1997 |
| JP | 2001-290361 | A | 10/2001 |
| JP | 2005-195886 | A | 7/2005 |

* cited by examiner

*Primary Examiner* — Ryan Walsh
*Assistant Examiner* — Philip Marcus T Fadul
(74) *Attorney, Agent, or Firm* — Fitzpatrick, Cella, Harper & Scinto

(57) ABSTRACT

An image forming apparatus includes an image bearing member, a development device which contains developer and develops a latent image on the image bearing member as a toner image, and an acquisition portion that acquires information about a residual amount of developer contained in the development device. In addition, a main body humidity sensor detects information about atmosphere humidity of a main body of the image forming apparatus, and a main body temperature sensor detects information about temperature of a main body of the image forming apparatus. A controlling portion controls development contrast as a potential difference between a DC bias applied to the development device and an image potential on the image bearing member, according to detection results of the main body humidity sensor and the main body temperature sensor, and information obtained by the acquisition portion.

9 Claims, 14 Drawing Sheets

IMAGE FORMING APPARATUS WITH DEVELOPMENT CONTRAST CONTROL

BACKGROUND OF THE INVENTION

1. Field of the Invention

The present invention relates to an image forming apparatus of an electro photographic system, such as a printer, a copying machine, and the like.

2. Description of the Related Art

In forming an image by the electro photographic system, a charging amount of toner is reflected to an image quality such as image density, and the like. For this reason, humidity dominating the charging amount is also a parameter to be obtained. Accordingly, Japanese Patent Laid-Open No. 2005-195886 discloses a technology of including a humidity detection unit in a toner bottle containing a replenishment toner to detect a humidity of toner.

Japanese Patent Laid-Open No. 2005-195886 discloses detecting a humidity of an outer wall of a toner cartridge as a humidity of toner since the humidity of the toner within the toner cartridge is familiar with humidity around the toner cartridge.

However, upon figuring out the humidity of the toner with more precision, the method is difficult to figure out a sufficient humidity.

SUMMARY OF THE INVENTION

The present invention is contrived to form a high quality of toner image by appropriately setting an image forming condition when humidity is changed.

A representative configuration of the image forming apparatus according to the present invention includes an image bearing member; a development device that develops an electrostatic latent image formed in the image bearing member; a detection portion that detects information on humidity within the apparatus body; a time measuring portion that acquires a time information; an acquisition portion that acquires information on a developer amount contained in the development device; and a controller that sets a parameter about an image density formed in a transfer material, based on history information about the information on humidity within the apparatus body and the time information detecting the information on humidity and based on information acquired by the acquisition portion.

Further features of the present invention will become apparent from the following description of exemplary embodiments with reference to the attached drawings.

DESCRIPTION OF THE EMBODIMENTS

First Embodiment

Figure 1:
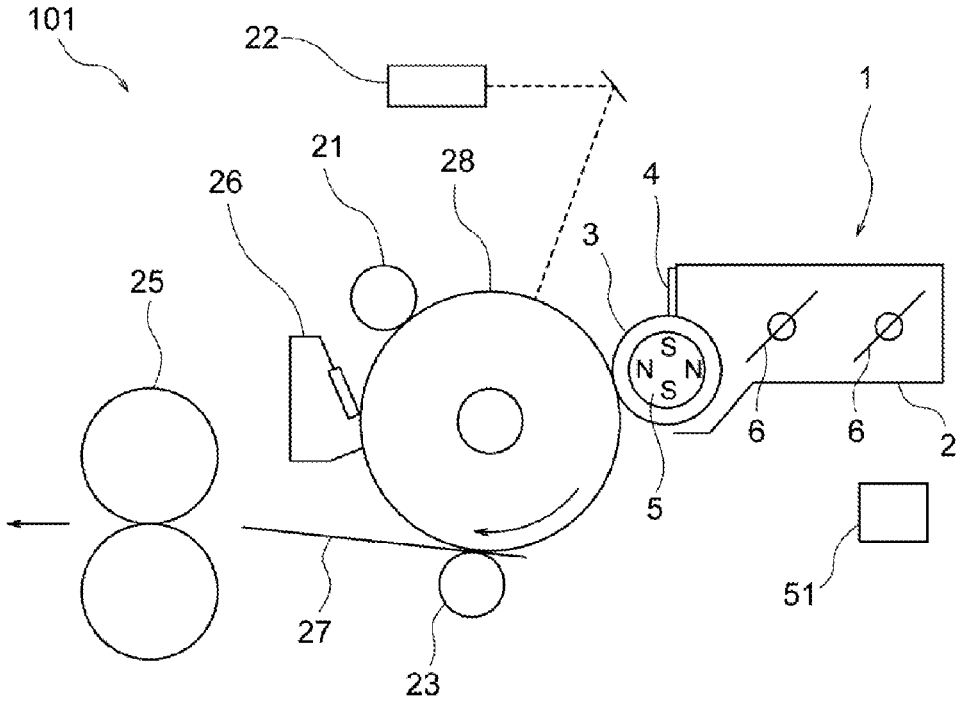
FIG. 1 is a diagram describing an image forming apparatus according to a first embodiment of the present invention.

FIG. 1 is a diagram describing an image forming apparatus according to a first embodiment of the present invention. First, an operation of an image forming apparatus 101 will be briefly described.

As illustrated in FIG. 1, a surface of a photosensitive drum 28 charged by a primary charger 21 is exposed by a laser irradiated from an exposure device 22. Therefore, an electrostatic latent image is formed on the photosensitive drum 28. The electrostatic latent image is developed by a development device 1 to acquire a toner image. The toner image is electrostatically transferred to a surface of a transfer material 27 in direct contact with the photosensitive drum 28 by a transfer charger 23.

The transfer material 27 to which the toner image is transferred is heated by a fixing device 25. Then, the toner image is fixed to the transfer material 27, and thus becomes a permanent image. In addition, after being transferred, the toner remaining on the photosensitive drum 28 is removed by a cleaner 26.

Figure 2:
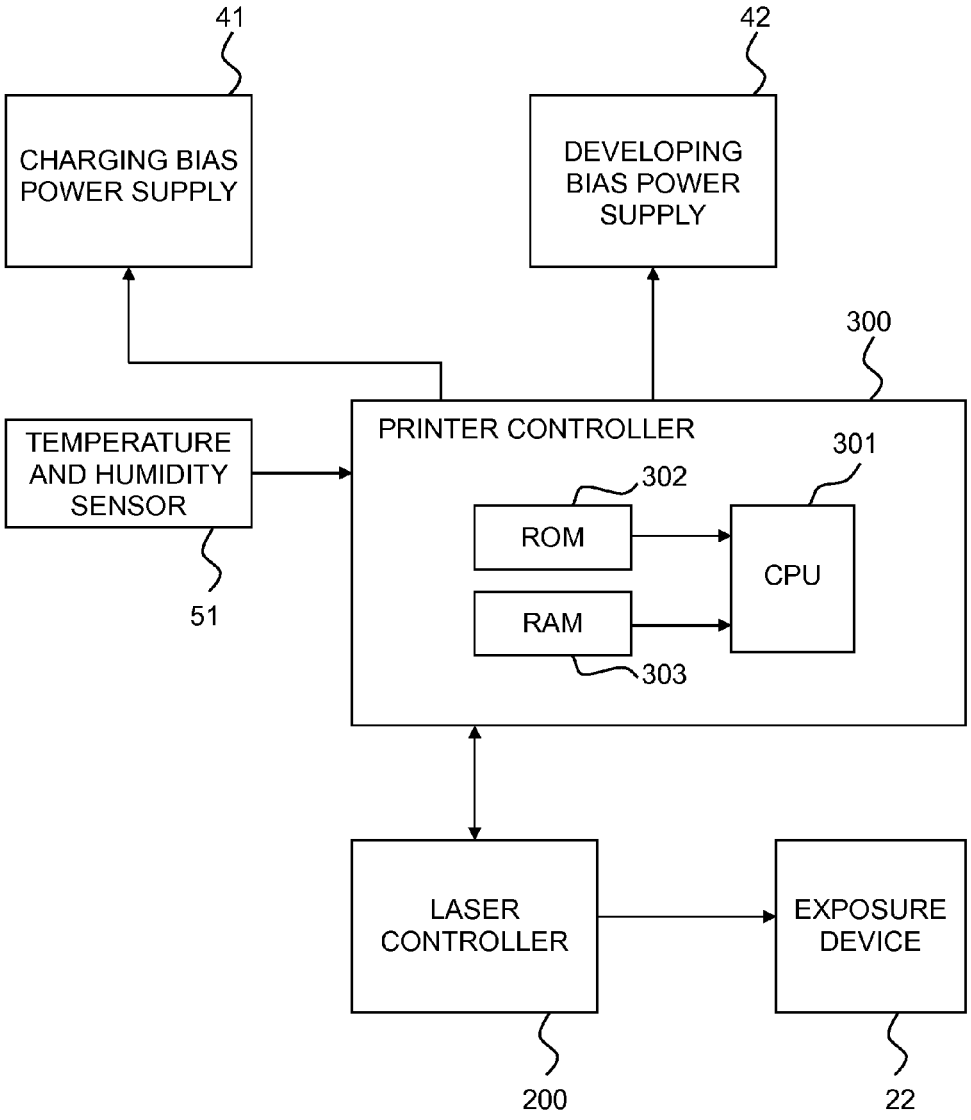
FIG. 2 is a block diagram of a control system of the image forming apparatus according to the first embodiment of the present invention.

FIG. 2 is a block diagram of a control system of the image forming apparatus according to the first embodiment of the present invention.

As illustrated in FIG. 2, a printer controller 300 (controller) is equipped with a CPU 301, a ROM 302, and a RAM 303 (storage portion). The printer controller 300 detects an output result of a temperature and humidity sensor 51 as a temperature sensor and a humidity sensor and controls an operation of a charging bias power supply 41, a developing bias power supply 42, and the like. Further, the printer controller 300 communicates with a laser controller 200 and controls irradiation of a laser by the exposure device 22.

Next, each component illustrated in FIGS. 1 and 2 will be described in more detail.

The photosensitive drum 28 is an OPC photosensitive member having negative charging polarity and functional layers mainly formed of resin are sequentially mounted on a grounded drum base made of an aluminum material. The surface of the functional layer is uniformly charged by applying a charging bias generated by overlapping an AC component with a DC component Vchg (V) from the charging bias power supply 41 to the primary charger 21. A potential of the portion is referred to as a blank portion potential Vd (V).

The "AC charging method" adjusts an AC component so that a value of Vchg (V) is approximately Vd (V). Based on image information, a maximum exposure is performed on the Vd (V) portion by the laser from the exposure device 22. Next, the exposed part is neutralized and thus a potential is proximate to a ground side. The potential of the portion is referred to as a potential of a maximum density portion (potential of an image portion) or V1 (V).

The image forming apparatus uses a magnetic one-component developing type using a magnetic toner as a developer. The magnetic toner is formed as a powder having a volume average particle of about 5 to 10 μm by grinding and classifying a material obtained by mixing and polymerizing resin mainly made of polyester with magnetite that is a magnetic material and colorant. In the toner of which the charging amount is changed due to its own humidity, when the humidity is low, the charging amount is increased and when the humidity is high, the charging amount is reduced.

The development device 1 has a developing sleeve 3 (developer bearing member) including a magnet 5 that is fixed to a non-magnetic metallic tube. The developing sleeve 3 is mounted on the photosensitive drum 28 in a contactless type, a magnetic toner carried in the developing sleeve 3 forms a magnetic brush, and the magnetic toner is charged with a friction while its layer thickness being regulated in a blade 4. In addition, the magnetic toner having the regulated layer thickness is proximate to the photosensitive drum 28 to perform the developing.

The developing sleeve 3 is applied with a developing bias generated by overlapping AC component with predetermined DC component Vdev (V) from a developing bias power supply 42. The AC component of the developing bias is a rectangular wave and a frequency of the AC component is 3 kHz and peak-to-peak voltage thereof is 1.5 kV. The developing manner is referred to as a contactless magnetic one-component type.

An absolute value of a difference of V1−Vdev is referred to as Vcont and indicates a potential of a maximum density portion of an electrostatic latent image viewed from the developing sleeve 3. In addition, an absolute value of Vd−Vdev is referred to as Vback. The Vback is a potential difference provided to guarantee a toner fogging of a blank portion. In the embodiment, the printer controller 300 controls the Vchg and the Vdev to change the Vcont and adjust the image density.

In case of the contactless magnetic one-component developing type, when a charging amount of the toner is too low, a force applied from an electric field generated by the developing bias is reduced. Therefore, a toner amount attached to the photosensitive drum 28 is reduced.

When the charging amount of the toner is slowly increased, the toner adhesion amount is increased, but when the charging amount of the toner is increased to some degree, the electric field by the developing bias is weakened by the electric field leading to a toner layer on the photosensitive drum 28. This phenomenon is remarkable when the charging amount of the toner is increased. For this reason, when the charging amount of the toner is too increased, the electric field is weakened due to the developing bias, such that the toner adhesion amount is being reduced. That is, as a general tendency of the contactless one-component developing type, a graph in which a horizontal axis indicates the charging amount of the toner and a vertical axis indicates the toner adhesion amount has a curve of a mountain shape of which the center rises.

In the developing condition according to the embodiment, a right portion of the mountain, that is a region in which when the charging amount of the toner is increased with the decrease in humidity, the toner adhesion amount is reduced may be used. For this reason, the toner adhesion amount is adjusted so as to be constant by increasing the Vcont under the low humidity environment and reducing the Vcont under the high humidity environment. The toner is consumed and the amount thereof is reduced due to the image formation, but the toner is transferred in a left direction illustrated in FIG. 1 in response to a rotation of an agitating member 6 that is mounted in a developing container 2.

(Method for Detecting Toner Humidity within Developing Container)

Feature portions of the image forming apparatus according to the embodiment will be described.

In the related art, it is assumed that the humidity of the toner within the toner cartridge (developing container) is familiar with humidity around the toner cartridge. For this reason, the humidity of an outer wall of a toner cartridge is detected as the humidity of the toner and a humidity detection value (humidity information) by a temperature and humidity sensor is used as it is to adjust the image forming conditions (Vcont, and the like).

However, according to reviewing in more detail by the present inventors, it could be understood that the humidity of the toner is not necessarily familiar with the humidity around the toner cartridge, but the following (1) and (2) are achieved.

(1) The toner contacting air undergoes "humidity adjustment" at a predetermined rate. The rate is referred to as "humidity adjustment rate" Herein, the "humidity adjustment" means that the humidity of the toner is familiar with (set to be the same value or the approximating value following up the environment) the humidity of ambient air.

Further, the "predetermined rate" is set to be about several tens of 10 to 100 (min) based on a time constant in an exponential function. This value is obtained by investigating whether, by containing the toner in the developing container, the humidity of the toner in the vicinity of a depth of several mm to several tens of mm at a powdered face follows up an external air at some time.

As described above, supposing there is a width in the humidity adjustment rate, it can be appreciated that the humidity detection value by the temperature and humidity sensor 51 is not the humidity of the toner as it is when humidity is changed over a period of several hours in response to a change of temperature in the morning or evening.

(2) Air does not sufficiently pass through the toner itself. For this reason, a toner far (depth of several hundred mm from a powdered face) from air within the bottle is substantially blocked from air.

In this case, if the humidity adjustment rate is represented by a time constant in an exponential function, the humidity adjustment rate becomes about several thousands to 10,000 (min). That is, changing humidity following up the surrounding environment is the only toner contacting an external air in the toner within the toner bottle. Meanwhile, it can be appreciated that the humidity of the toner blocked from the external air is seldom familiar with external air.

Considering these results, it can be appreciated that "when a contact area with air is increased, the humidity adjustment rate of a predetermined capacity of toner is increased. Meanwhile, when the contact area with air is reduced, the humidity adjustment rate is reduced".

Further, the overall tendency said to be "when a shape of a toner as a powder is approximately the same, in the case in which a capacity of toner is large, the humidity adjustment rate is reduced. Meanwhile, when the capacity of toner is small, the humidity adjustment rate is fast" can be understood.

Figure 3A:
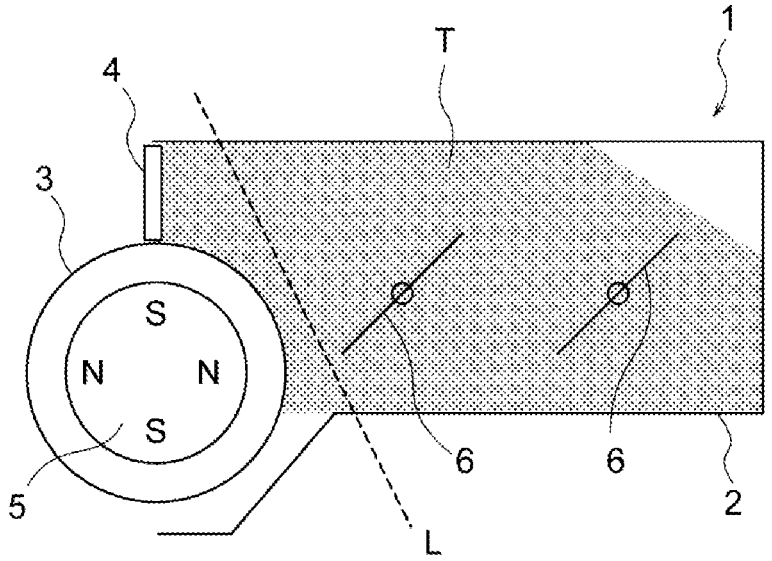
FIG. 3A is a diagram describing a shape of toner within a development device of the first embodiment of the present invention.
Figure 3B:
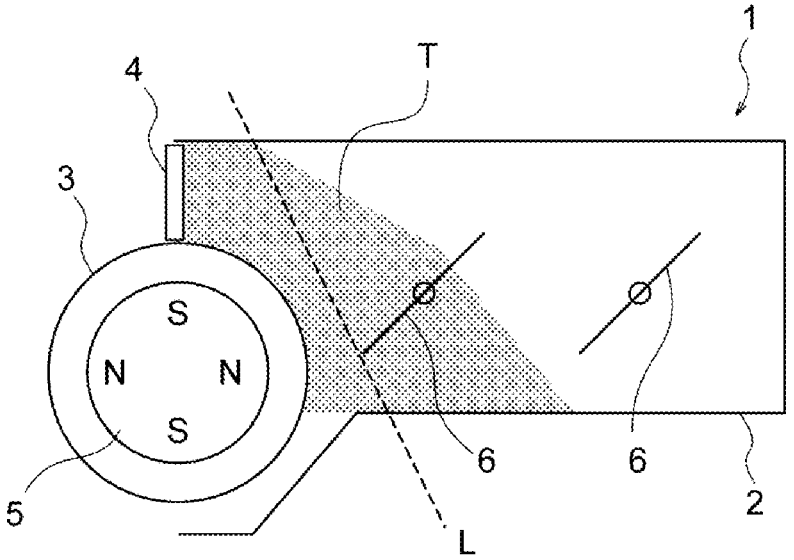
FIG. 3B is a diagram describing the shape of toner within the development device of the first embodiment of the present invention.

FIGS. 3A and 3B are diagrams describing the shape of the toner within the development device according to the first embodiment of the present invention. As described above, illustrated in FIG. 3A, when there is a large amount of toner T within the development device 1, the humidity adjustment rate of a toner T is slow. Meanwhile, as illustrated in FIG. 3B, when there is a small amount of toner T within the development device 1, the humidity adjustment rate is rapid. The embodiment adjusts the image forming conditions in consideration of the tendency.

Further, the adjustment of the image forming conditions also considers the tendency that in the development device 1, the humidity adjustment rate of the vicinity of the opening facing the developing sleeve 3 is faster than that of another portion (portion corresponding to the right within the development device 1 in FIGS. 3A and 3B), in addition to considering the toner amount.

A boundary between the vicinity of the opening and another portion is a virtual line (dashed line L) drawn in the vicinity of the developing sleeve 3. The development device 1 is divided into left and right regions by the dashed line L and different humidity adjustment rates are applied to the left and right regions of the dashed line L. Further, the dashed line L indicates a conceptual position and practically, no configuration of components is required at the position.

In actual, the "humidity adjustment rate" or the "toner humidity" to be described below are continuously changed within the development device 1. For the detailed calculation, it is regarded as preferable to subdivide the inside of the development device 1 and then apply Equation, which causes the complication of computation Equation or the increase in calculation, and as a result is not preferable. Therefore, according to the embodiment, the inside of the development device 1 is partitioned into two places based on the dashed line L as a boundary and the humidity of the toner within the development device 1 is calculated based on Equation as described below. According to the devise, the image forming condition may be required and the calculation may be simply made with sufficient precision. Next, this will be described in detail.

First, the volume average humidity $RH_{Lleft}$ of the toner in the left region of the dashed line L and the volume average humidity $RH_{Lright}$ of the toner in the right region are obtained by the following calculation. However, in this calculation, "the left region of the dashed line L is filled with a toner" is considered as a premise and in detail, the case in which a toner amount W (g) is within a predetermined range is considered as a premise. In the embodiment, a predetermined range is 100 (g)≤W≤800 (g). Further, 800 (g) is a toner amount that is initially charged by the development device 1 according to the embodiment. In addition, the toner amount of the development device 1 is an amount of image data formed or as illustrated below, is calculated by any one of the exposure amounts of the exposure device forming the electrostatic latent image.

It is appropriate to consider initial values of the $RH_{Lleft}$ and the $RH_{Lright}$ as the environment humidity when the toner is charged in a factory. In the present invention, the initial values are set to be 50%. Further, the value is returned to the initial values at a timing when the development device 1 is exchanged with a new product, that is, when the development device 1 of the new product in the sealed state is opened.

First, the $RH_{Lleft}$ will be described. The left region of the dashed line L contacts the external air from the vicinity of the developing sleeve 3 and has a relatively fast humidity adjustment rate. The humidity adjustment rate may be obtained experimentally and the humidity adjustment time constant $\beta_{Lleft}$ of the portion is 200 min. This region has a constant volume (V (g)=100 g) and the humidity adjustment time constant $\beta_{Lleft}$ is assumed to be approximately constant while the toner is present over the overall region. In addition, the effect of humidity in the right region of the dashed line L is much smaller than that of the external air from the developing sleeve 3 side, which may be disregarded in calculation.

Herein, "during the change in the $RH_{Lleft}$, a humidity value RHp considering an amount changed by the humidity adjustment" is represented by the following Equation.

$$RHp=(RHm_{Lleft}-rh)\times\exp(-(tn-tm)/\beta_{Lleft})+rh \quad \text{Equation (1)}$$

The parameters used in the equation are given below.

$RHm_{Lleft}$: The value (RH %) of $RH_{Lleft}$ previously calculated and stored in the printer controller 300 rh: The humidity value (RH %) of the external air detected by the temperature and humidity sensor 51

$\beta_{Lleft}$: The humidity adjustment time constant (min) in the left region of the dashed line L That is, the humidity information of the developer in the vicinity of the current developing sleeve changed by the humidity adjustment is calculated based on history information about humidity information detected by the temperature and humidity sensor 51 and time information detecting the humidity information.

Further, as the toner image, the toner discharged from the region and the toner introduced from the right region of the dashed line L so as to supplement the toner are present. Supposing the discharged toner amount and the introduced toner amount are the same in calculation, they may be set to be Δz (g).

Meanwhile, since the humidity of the discharged toner and the humidity of the introduced toner are different from each other, this state is added to the calculation. Δz is the toner adhesion weight of the toner image. For this reason, the printer controller 300 acquires total sum data (Σ) of the exposure amount from the laser controller 200 as the acquisition portion and Δz is set as follows based on the total sum data.

$$\Delta z=\sigma\times(\Delta z_{ff}/\sigma_{ff}) \quad \text{Equation (2)}$$

The parameters used in the equation are given below.

$\Delta z_{ff}$: Toner consumption amount (g) when the maximum density image on the whole surface is exposed $\sigma_{ff}$: Value of Σ when the maximum density image on the whole surface is exposed The "(average) humidity value $RH_{Lleft}$ of the toner in the left region of the dashed line L" to be currently obtained may be obtained by correcting "the changed amount in humidity due to replacement" with respect to the foregoing RHp.

This is represented by the following Equation.

$$RH_{Lleft}=RHp\times(V-\Delta z)/V+RHm_{Lright}\times\Delta z/V \quad \text{Equation (3)}$$

The parameters used in the equation are given below.

V: The toner weight (g) in the left region of the dashed line L

Δz: The toner weight (g) replaced due to the formation of the toner image $RHm_{Lright}$: The previous calculation value of the average humidity (RH %) of the toner in the right region of the dashed line L In the above Equation (3), the previous calculated humidity value $RHm_{Lright}$ is used as the "average humidity of the toner in the right region of the dashed line L". Conceptually, the current humidity value $RH_{Lright}$ is used, but in view of calculation, the $RH_{Lright}$ may not be obtained until the $RH_{Lleft}$ is obtained, as represented by the following Equation (4).

Therefore, considering that the humidity adjustment time constant $\beta_{Lright}$ to be described below is larger than the humidity adjustment time constant $\beta_{Lleft}$ of Equation (1), it may be considered that the $RH_{Lright} \approx RHm_{Lright}$ in the period of the time tm and tn to obtain the $RH_{Lleft}$. For this reason, as represented by Equation (3), the value of the $RH_{Lleft}$ with sufficiently good precision can be obtained based on the processing using the previously calculated humidity value $RHm_{Lright}$ rather than using the current humidity value $RH_{Lright}$.

Next, the humidity value $RH_{Lleft}$ of the toner in the left region of the dashed line L will be described below. According to the reviewing of the present inventors, it is confirmed that the following two points are present in the right region of the dashed line L. That is, when the toner amount W present in the region is increased, the humidity adjustment rate is slow and the humidity adjustment time constant $\beta_{Lright}$ is increased. In addition, when the toner amount W is reduced, the humidity adjustment rate is fast and the humidity adjustment time constant $\beta_{Lright}$ is reduced.

Figure 4A:
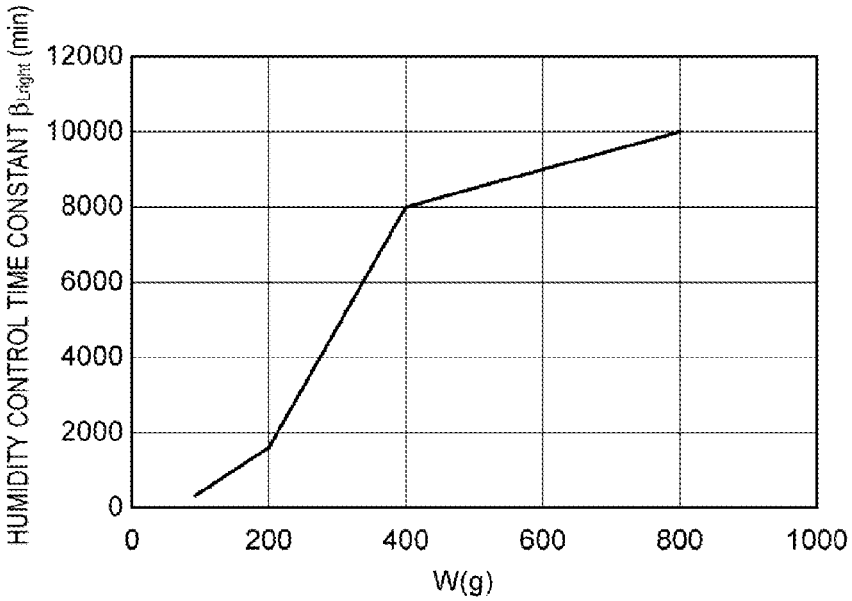
FIG. 4A is a graph illustrating a relationship between a residual amount of toner within the development device and a humidity adjustment time constant of the first embodiment of the present invention.
Figure 4B:
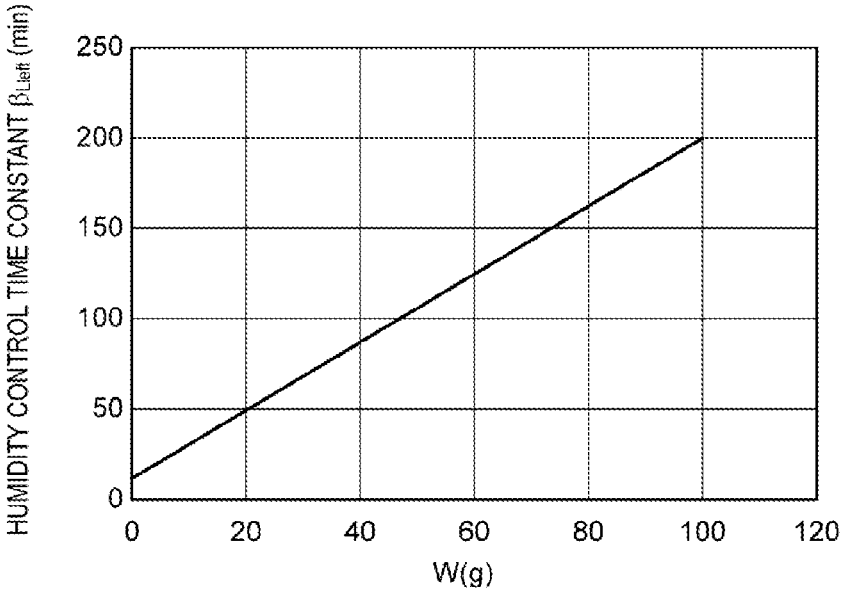
FIG. 4B is a graph illustrating a relationship between a residual amount of toner within the development device and a humidity adjustment time constant of the first embodiment of the present invention.

FIGS. 4A and 4B are graphs illustrating a relationship between the residual amount of the toner within the development device according to the first embodiment of the present invention and the humidity adjustment time constant. In detail, FIG. 4A illustrates the humidity adjustment time constant in the right region of the dashed line L and FIG. 4B illustrates the humidity adjustment time constant in the left region of the dashed line L.

The graph of FIG. 4A in which a horizontal axis indicates the toner amount W (g) and a vertical axis indicates the humidity adjustment time constant $\beta_{Lright}$ results in the right rising. That is, when the toner amount W is reduced, the humidity adjustment time constant $\beta_{Lright}$ is reduced and the humidity adjustment rate is increased. Meanwhile, when the toner amount W is increased, the humidity adjustment time constant $\beta_{Lright}$ is increased and the humidity adjustment rate is reduced.

The reason why the result is obtained is as follows. First, the right toner of the dashed line L has a fast humidity adjustment rate in response to the reduction in the toner capacity. In this state, as illustrated in FIG. 3B, when air is mixed in the right of the toner, the contact area between the toner and air is increased and the humidity adjustment rate is faster. In addition, the graph of FIG. 4A is experimentally obtained from data obtained by disposing the small temperature and humidity sensor in each component within the development device 1 and changing the external humidity.

The humidity of air in the right region of the dashed line L is not the relative humidity rh of external air, but is substantially the same as the humidity value $RH_{Lleft}$. The air in the right region of the dashed line L is originally air introduced from the external air introduced from the developing sleeve 3, but is air passing through the toner having the humidity value $RH_{Lleft}$. Moisture is exchanged between the air and the toner while the air passes through the toner. However, comparing air with the toner of the same volume, an amount absorbing moisture is about 1:100. For this reason, it may be assumed that the timing when the exchange of moisture reaches a balance is the timing when the relative humidity of air and the relative humidity of the toner are the same, and a balance point approaches the relative humidity value of the original toner.

Considering these aspects, the average humidity $RH_{Lright}$ of the toner in the right region of the dashed line L is obtained by the following Equation.

$$RH_{Lright}=(RHm_{Lright}-RH_{Lleft})\times\exp(-(tn-tm)/\beta_{Lright})+RH_{Lleft} \quad \text{Equation (4)}$$

The parameters used in the equation are given below.

$RHm_{Lright}$: The calculation value (RH %) of the previous $RH_{Lright}$ $RH_{Lleft}$: The average humidity value (RH %) of the toner in the left region of the dashed line L calculated by the above Equation (3)

tn: The time (min) when the current humidity is calculated tm: The time (min) when the previous $RHm_{Lright}$ is calculated $\beta_{Lright}$: The humidity adjustment time constant (min) in the left region of the dashed line L That is, the current humidity information of the developer in the right region of the dashed line L changed by the humidity adjustment is calculated based on the humidity information $RHm_{Lright}$ acquired based on the detection result of the temperature and humidity sensor 51 and the time information tn and tm when the humidity information is detected.

Finally, for the case in which the toner amount W (g) is 0 (g)≤W<100 (g), in order to simplify the calculation, the toners present at both sides of the dashed line L are combined and handled. In principle, considering the state in which there is no the replacement of the toner in the case of 100 (g)≤W≤800 (g), the humidity value $RH_{Lleft}$ to be obtained is obtained in the same form as the above Equation (2). That is, $$RH_{Lleft}=(RHm_{Lleft}-rh)\times\exp(-(tn-tm)/\beta_{Lleft})+rh \quad \text{Equation (5)}$$

However, since the assumed amount of the toner is not constant, the value of the $\beta_{Lleft}$ that is a time constant is changed by W depending on the above Equation (1). In detail, this is defined by the graph illustrated in FIG. 4B. In addition, the graph of FIG. 4B is experimentally obtained from data obtained by disposing the small temperature and humidity sensor in each component within the development device 1 and changing the external humidity. In addition, the value of the $\beta_{Lleft}$ at the point of W=0 (g) is set to be 10 (min). This is to prevent a denominator from being set to be 0 in the above Equation (5).

As described above, when the humidity value $RH_{Lleft}$ of the left part based on the dashed line L within the development device 1 is appropriately obtained, the humidity value dominates the charging amount of the developed toner, such that the appropriate charging amount and the appropriate image forming conditions may be set.

Figure 5:
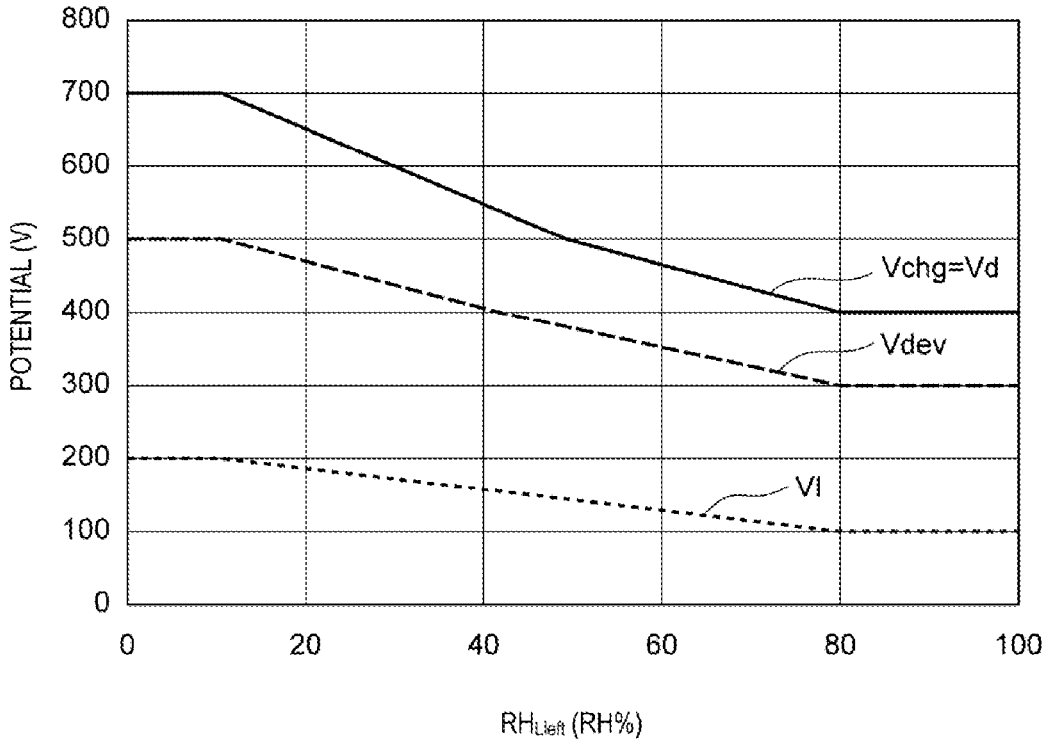
FIG. 5 is a graph illustrating a relationship between a humidity value $RH_{Left}$ obtained in the first embodiment of the present invention and Vchg and Vdev.

In the embodiment, the Vchg and the Vdev are set according to the graph of FIG. 5. Therefore, the image density is constant by adjusting the Vcont (difference between the Vdev and the V1). FIG. 5 is a graph illustrating the relationship between the humidity value $RH_{Lleft}$ obtained in the first embodiment and the Vchg and the Vdev. The graph of FIG. 5 is obtained experimentally.

Figure 6:
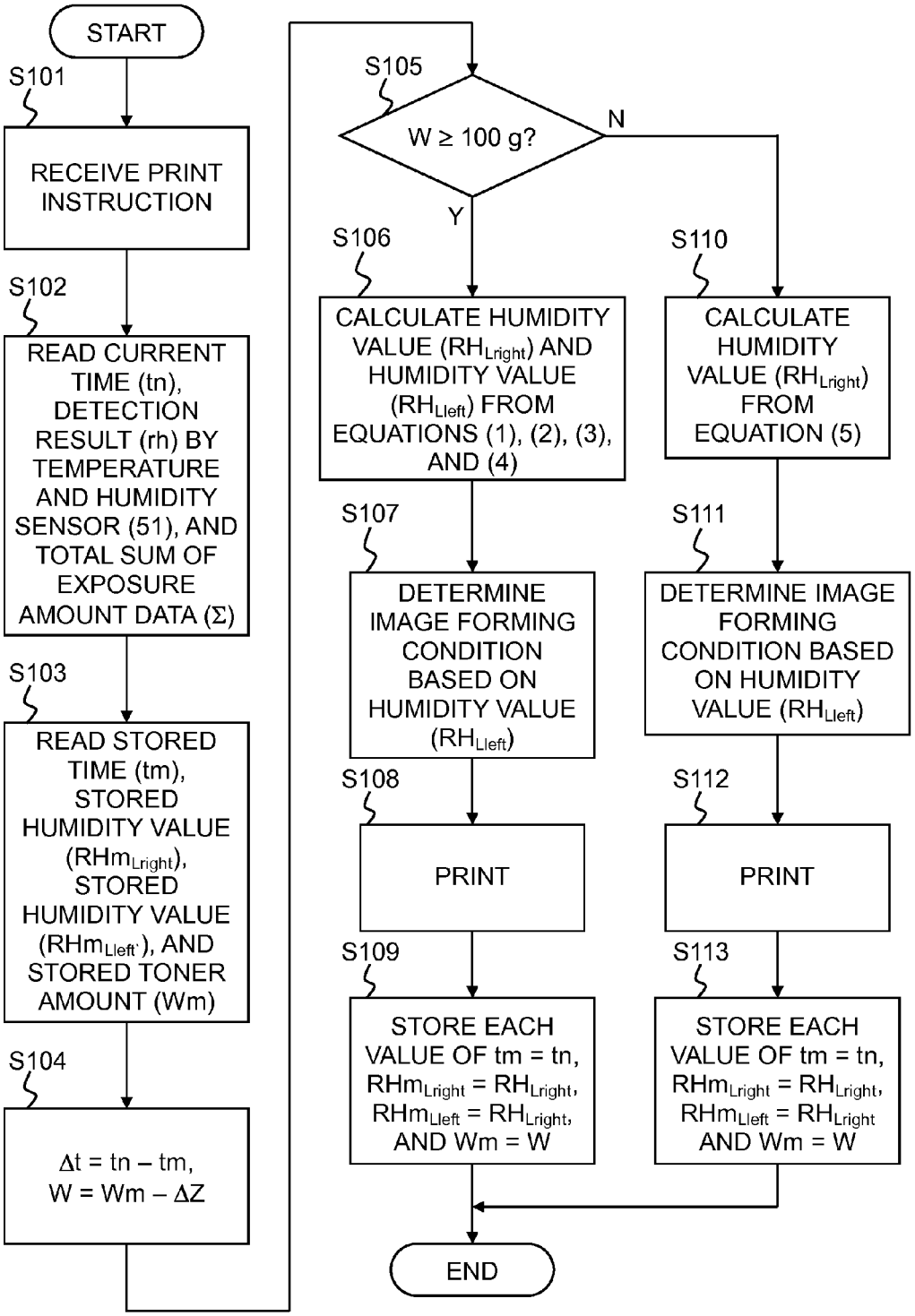
FIG. 6 is a flow chart describing a printer control according to the first embodiment of the present invention.

FIG. 6 is a flow chart describing a printer control according to the first embodiment of the present invention. Hereinafter, an operation of the image forming apparatus will be described in detail with reference to the flow chart of FIG. 6. The operation of the image forming apparatus is collectively performed by the printer controller 300.

First, the printer controller 300 receives a print instruction (step S101). Next, the printer controller 300 acquires the current time to from a time measuring portion. As the time measuring portion, an embedded time measuring portion may be permitted and an external time measuring portion such as a server and a terminal may be permitted. The external time measuring portion is connected with the printer controller 300 directly or via the laser controller 200. Further, the printer controller 300 reads the detection result of the relative humidity rh from the temperature and humidity sensor 51. In addition, the printer controller 300 reads the total sum data Σ of the exposure amount calculated from the image data printed from now on by the laser controller 200 (step S102).

Next, the printer controller 300 reads stored $time_{tm}$, the humidity value $RHm_{Lright}$ the humidity value $RHm_{Lleft}$, and the toner amount Wm from a non-volatile RAM 303 (step S103).

Next, a value of Wm−Δz is calculated as W (step S104). Further, it is determined whether W is equal to or larger than 100 g (step S105). As described above, the determination corresponds to a determination of whether to calculate the humidity by dividing the inside of the development device 1 using the dashed line L.

In the step S105, in case of Y, the printer controller 300 calculates the humidity value $RH_{Lright}$ and the humidity value $RH_{Lleft}$ from the above Equations (1), (2), (3), and (4) (step S106). In addition, the Vchg and the Vdev that are the image forming conditions are determined from the relationship between the humidity and the charging bias illustrated in FIG. 5, based on the calculation value of the humidity value $RH_{Lleft}$ (step S107). Herein, the ROM 302 is stored with the graphs of FIGS. 4A and 4B and the printer controller 300 obtains the $\beta_{Lleft}$ used in the above Equation (1) from FIG. 4B and the $\beta_{Lright}$ used in the above Equation (4) from FIG. 4A.

Next, the printer controller 300 performs a print operation. Herein, the printer controller 300 sets the value of the Vchg in the charging bias power supply 41 and the value of the Vdev in the developing bias power supply. The image formation is performed based on the set value to obtain the print output of the constant image density (step S108).

After the image forming operation, values of tm=tn, $RHm_{Lright}=RH_{Lright}$, $RHm_{Lleft}=RH_{Lleft}$, and Wm=W are stored in the non-volatile RAM 303 (step S109) to prepare for the next print. By doing so, the operation of the image formation ends.

In the S105, in case of N, the value of the humidity value $RH_{Lright}$ is not required. For this reason, the printer controller 300 calculates the humidity value $RH_{Lleft}$ from the foregoing Equation (5) (step S110).

The Vchg and the Vdev that are the image forming conditions are determined from the relationship between the humidity and the charging bias illustrated in FIG. 5, based on the calculation value of the humidity value $RH_{Lleft}$ (step S111). Herein, the printer controller 300 obtains the $\beta_{Lleft}$ used in the above Equation (5) with reference to the FIG. 4B. Under the condition, the printer controller 300 performs the print operation (step S112). Further, after the image formation, tm=tn, $RHm_{Lleft}=RH_{Lleft}$, Wm=W (step S113).

As described above, in the S105, the case of N, that is, the case of the toner amount W<100 (g) is different from the case of Y, that is, the toner amount W≥100 (g) in the S105 and no calculation process of the $RH_{Lright}$ is present. For this reason, the printer controller 300 stores the value of the read $RHm_{Lright}$ in the $RHm_{Lright}$ as it is, secures the value to prevent the malfunction, and prepares for the next print and the operation of the printer controller 300 ends.

As described above, the printer controller 300 sets the changed amount of the parameter about the image density to the change in humidity to be small when the residual amount of the toner within the development device 1 is large and to be large when the residual amount of the toner within the development device 1 is small. That is, when the residual amount of the toner within the development device 1 is large, the change width of the image density set under the premise that the change in humidity of the toner fed to the photosensitive drum 28 is small is set to be small. Meanwhile, when the residual amount of the toner within the development device 1 is small, the change width of the image density set under the premise that the change in humidity of the toner is large is set to be large. As described above, when the humidity is changed, the high quality of toner image may be formed by appropriately setting the image forming conditions. In other words, when the Vcont as the parameter about the image density is changed in response to the change in humidity of the body atmosphere, the Vcont is controlled based on the above Equations (3) and (4). For this reason, compared with the case in which the residual amount of the toner within the development device 1 is large, in the case in which the residual amount of the toner is small, the changed amount of the Vcont to the change in humidity per unit time is increased.

Although the first embodiment of the present invention is described above, the present invention is not limited to the foregoing configuration. For example, the image forming apparatus that does not have the time measuring portion may be operated using the number of sheets for forming an image instead of the time information. In view of the precision, the configuration of the embodiment is preferable, but the effect of the present invention can be sufficiently obtained. Further, the toner amount W may be obtained based on the detection result by installing the toner residual amount sensor of a piezo type, an optical type, or the like that is installed in the development device 1.

Second Embodiment

Figure 7:
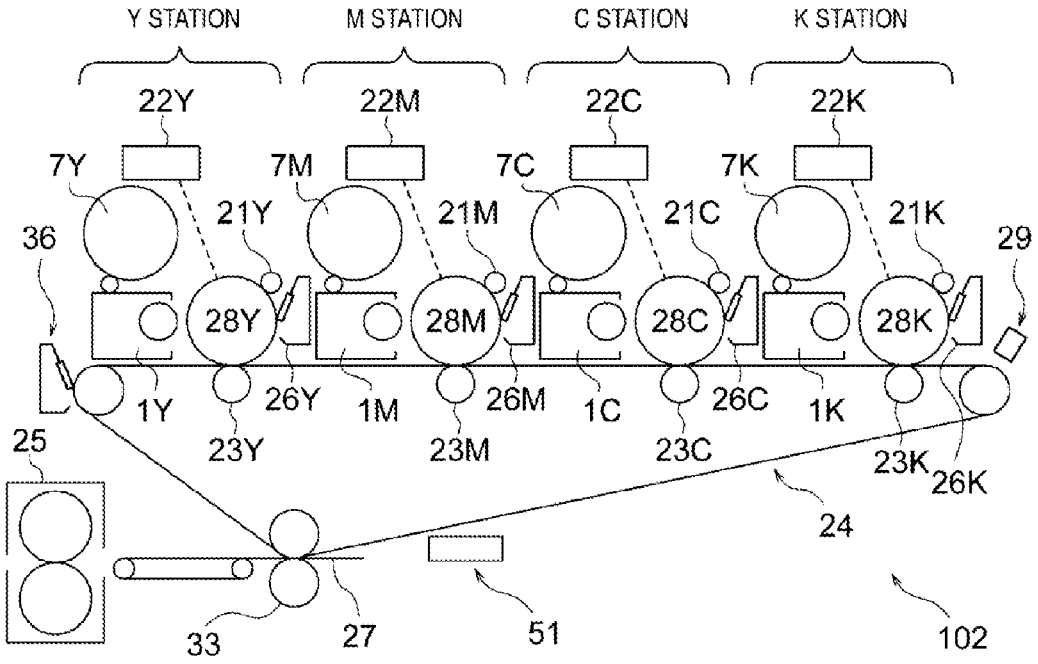
FIG. 7 is a diagram describing an image forming apparatus according to a second embodiment of the present invention.

A configuration of the second embodiment of the present invention will be described below. FIG. 7 is a diagram describing an image forming apparatus according to a second embodiment of the present invention. The same components as described above are denoted by the same reference numerals, and therefore, the description thereof will be omitted.

The embodiment has the following features as compared with the first embodiment. That is, the embodiment has features in which the developing type is a two-component developing type, the consumed toner is replenished from the toner bottle, and the printer controller 300 calculates the humidity around the development device and the hopper and calculates the humidity of the two-component developer and the humidity of the replenished toner.

To use the two-component phenomenon as the developing type, there is a need to replenish the toner consumed due to the developing by the predetermined amount of two-component developer. In this case, when the humidity of the consumed toner is different from the humidity of the replenished toner, the humidity of the two-component developer is different due to the difference and the replaced amount. Herein, in order to accurately calculate the humidity of the replenished toner, the spirit of the present invention is applied.

As illustrated in FIG. 7, the image forming apparatus according to the embodiment has stations (image forming portions) for forming toner images of yellow (Y), magenta (M), cyan (C), and black (K). Since the configuration of each image forming portion is the same, in the following description, subscripts attached to the toner colors Y, M, C, and K are appropriately omitted and only reference numerals are indicated.

The image forming apparatus 102 according to the embodiment of the present invention is a so-called tandem type full-color image forming apparatus provided by disposing the photosensitive drums 28 (Y, M, C, K) in parallel.

The image forming apparatus 102 prepares the toner images of each color in the stations (Y, M, C, K) of each color and transfers the prepared toner images to an intermediate transfer belt 24 by a transfer charger 23 (primary transfer roller). The toner image of four colors is polymerized on the intermediate transfer belt 24 by allowing each station to perform the primary transfer.

Next, the image forming apparatus 102 secondarily transfers the toner image of four colors to the transfer material 27 in a lump by the transfer charger 33 (secondary transfer roller). The transfer material 27 to which the toner image is transferred is heated and pressurized by the fixing device 25. Then, the toner image is fixed to the transfer material 27, and thus becomes a permanent image. The residual toner that is not transferred to the transfer material 27 is removed by an intermediate transfer belt cleaner 36.

Figure 8:
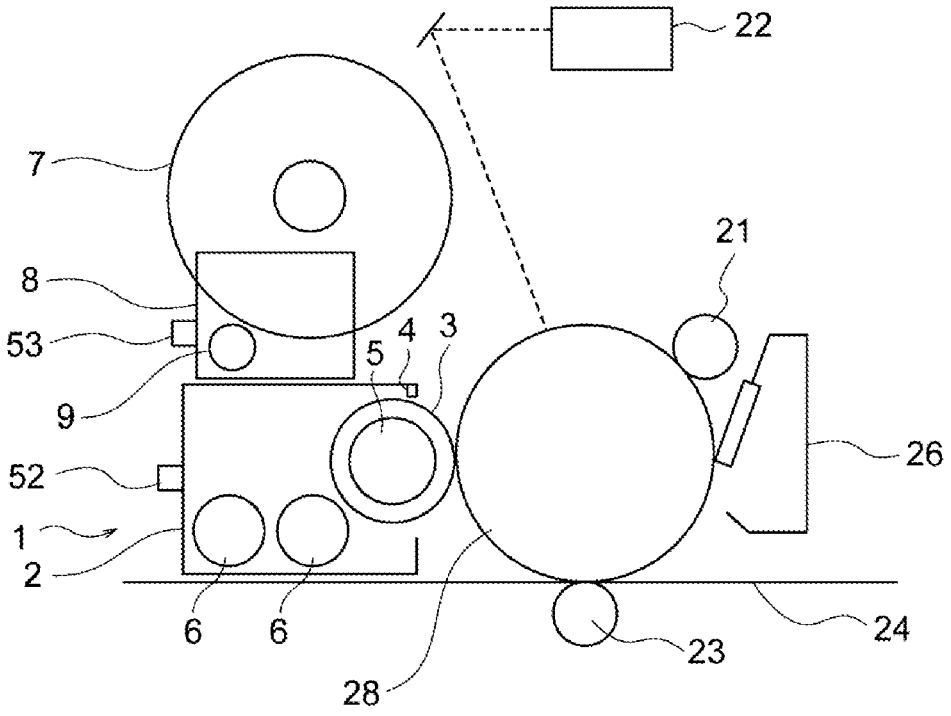
FIG. 8 is a diagram describing each station according to a second embodiment of the present invention.

FIG. 8 is a diagram describing each station according to a second embodiment of the present invention. Referring to FIG. 8, the development device 1 (Y, M, C, k) of each station will be described in detail. According to the embodiment, each station has the toner bottle 7 or the hopper 8 as the replenishment toner tank (replenishment device).

As illustrated in FIG. 8, in the embodiment, the "two-component developing type" that mixes a non-magnetic toner and a magnetic carrier and uses the mixtures as a developer has been adopted. The non-magnetic toner is formed of mainly a polyester-based resin or a styrene acrylic resin and is obtained by grinding and classifying a resin obtained by mixing colorants meeting each color of black, cyan, magenta, and yellow and a wax that is a fixing aid.

The magnetic carrier uses one formed by coating a core made of a resin powder such as ferrite, and the like, with a resin. One having the volume average particle of 20 to 100 μm is used. The toner consumed at the time of forming the toner image is once stored in the hopper 8 from the toner bottle 7. A predetermined amount of the toner is measured by a measuring screw 9 in the state in which the toner keeps a powdered face within a predetermined range for the purpose of stabilizing a replenishment amount within the hopper 8 and is replenished to the developing container 2. The replenished toner is mixed and agitated with the two-component developer by an agitating member 6 within the developing container 2. The toner bottle 7 has a cylindrical shape elongated in a vertical direction to a ground illustrated in FIG. 8 and replenishes the hopper 8 with the toner from the opening mounted in front of the image forming apparatus 102.

Further, as the sensor, a developing temperature sensor 52 and a hopper temperature sensor 53 are mounted.

Figure 9:
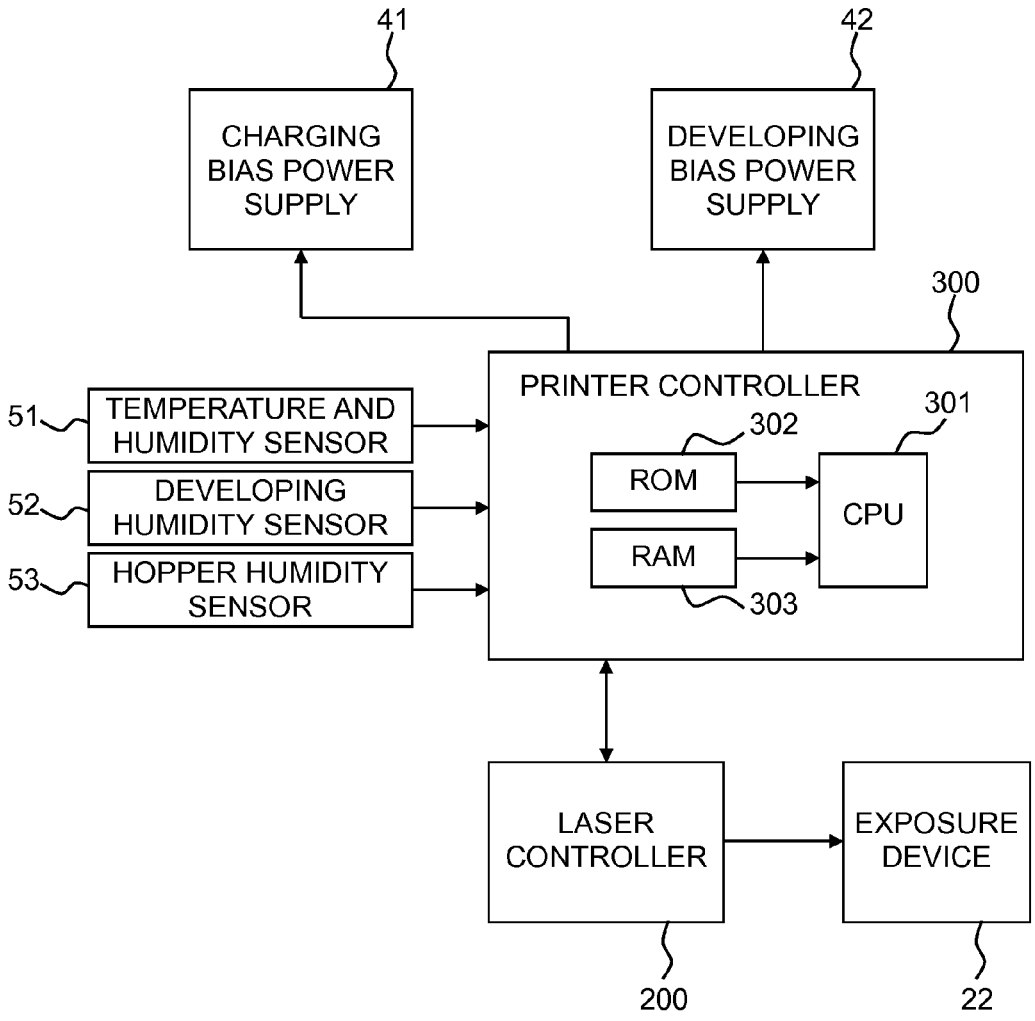
FIG. 9 is a control block diagram for forming an image according to the second embodiment of the present invention.

FIG. 9 is a control block diagram for forming an image according to the second embodiment of the present invention. As the sensor, at least, the temperature and humidity sensor 51, the developing temperature sensor 52, and the hopper temperature sensor 53 are mounted.

The temperature and humidity sensor 51 detects a temperature $tmp_{body}$ (° C.) and a relative humidity $rh_{body}$ (RH %) within the image forming apparatus 102 (see FIG. 7).

Further, each development device 1 illustrated in FIG. 8 is mounted with the developing temperature sensor 52 to detect the temperature $tmp_{developing}$ (° C.) of the development device 1. Each of the developing temperature sensors 52 is disposed to contact or be proximate to the developing container 2. In addition, each hopper 8 is mounted with the hopper temperature sensor 53 to detect the temperature $tmp_{hopper}$ (° C.) of the hopper 8. The hopper temperature sensor 53 is disposed to contact or be proximate to the hopper 8.

The temperature $tmp_{developing}$ of the development device 1 is self-increased due to the friction of the two-component developer when the developing operation is performed. For this reason, the temperature $tmp_{developing}$ is higher than temperature $tmp_{body}$ of the temperature and humidity sensor 51 during, particularly, the image formation. Meanwhile, the temperature $tmp_{hopper}$ is approximately equal to the temperature $tmp_{body}$ (° C.) of the temperature and humidity sensor 51.

The printer controller 300 calculates a weight absolute moisture content (ABS (g/kgDA)) of air within the apparatus from the temperature $tmp_{body}$ and the relative humidity $rh_{body}$ (RH %). Further, the relative humidity $rh_{developing}$ (RH %) in the vicinity of the development device 1 is calculated from the value and the temperature $tmp_{developing}$. In addition, the relative humidity $rh_{hopper}$ (RH %) in the vicinity of the hopper 8 is calculated from the temperature $tmp_{hopper}$.

Herein, the calculation of the weight absolute moisture content (ABS (g/kgDA)) will be described. The value is a value representing how many gram (g) of water is melted per dried air (DryAir) of 1 kg and is obtained by solving a state equation of abnormal gas from the vapor pressure and relative humidity of the air.

First, a (saturation) water vapor pressure Eσ (τ) (Pa) of air at temperature τ(° C.) is obtained. This is obtained by an approximation equation of Tetens as follows, in the region of temperature of 0° C. to 60° C.

$$E\sigma(\tau)=611\times10\hat{}(7.5\times\tau/(\tau+237.3))\ (\text{Pa}) \qquad \text{Equation (101)}$$

The water vapor pressure $E(\tau)$ (Pa) in the air is obtained by multiplying the relative humidity(rh) by the saturation water vapor pressure to form $$E(\tau)=E\sigma(\tau)\times rh \qquad \text{Equation (102).}$$

Herein, the weight absolute moisture content (ABS (g/kgDA)) to be obtained corresponds to one obtained by taking a ratio (g/gDryAir) of weight of water=Mwater (g) and weight of dried air MDryAir (g) and further making 1,000 times the value.

Mol number nwater and nDryAir of water and dried air, respectively are obtained by the following Equations.

$$n\text{water}=M\text{water}/(\text{molecular weight of water})$$

$$n\text{DryAir}=M\text{DryAir}/(\text{molecular weight of air})$$

When the state equation of the abnormal gas is applied to water, a volume V and a gas constant R are as follows.

$$\text{Water: } E(\tau)\times V=(M\text{water}/(\text{molecular weight of water}))\times R\times\tau \qquad \text{Equation (103)}$$

The partial pressure of the dried air corresponds to one obtained by subtracting a partial pressure of water from 1 atmosphere (101300 Pa), and therefore the state equation of the abnormal gas for the dried air is as follows.

$$\text{Dried air: } (101300-E(\tau))\times V=(M\text{DryAir}/(\text{molecular weight of air}))\times R\times\tau \qquad \text{Equation (104)}$$

Herein, this is arranged as follows, based on Equation (103)/Equation (104).

$$\text{Weight absolute moisture content (g/gDA)}=(\text{molecular weight of water}\times E(\tau))/\text{molecular weight of air}\times(101300-E(\tau)) \qquad \text{Equation (105)}$$

Molecular weight of water=18.0154, average molecular weight of air=28.996, and a numerical value of the dried air is represented by kg. In this case, the weight absolute moisture content (ABS) is obtained by the following Equation.

$$\text{Weight absolute moisture content ABS (g/kgDA)} = 621.3 \times E(\tau)/(101300 - E(\tau)) \quad \text{Equation (106)}$$

That is, the weight absolute moisture content $ABS_{body}$ obtained from the temperature $tmp_{body}$ and the relative humidity $rh_{body}$ (RH %) measured by the temperature and humidity sensor 51 is obtained as follows based on Equations 102 and 106. That is, $$ABS_{body} = 621.3 \times E(tmp_{body}) \times \text{relative humidity } rh_{body} / (101300 - E(tmp_{body}) \times \text{relative humidity } rh_{body}) \quad \text{Equation (107)}$$

Here, the relative humidity rh at the temperature tmp is a ratio of the absolute moisture content of the air to the saturation weight absolute moisture content at the temperature. The $ABS_{saturation}$ (tmp) that is the saturation weight absolute moisture content of the temperature tmp (° C.) is set to be rh=100 (%) in Equation (102). For this reason, $$ABS_{saturation}(tmp) = 621.3 \times E(tmp)/(101300 - E(tmp)) \quad \text{Equation (108)}$$

As described above, the relative humidity $rh_{developing}$ and the relative humidity $rh_{hopper}$ to be obtained are as the following Equation. That is, $$rh_{developing} = ABS_{body}/ABS_{saturation}(tmp_{developing}) \quad \text{Equation (109)}$$

$$rh_{hopper} = ABS_{body}/ABS_{saturation}(tmp_{hopper}) \quad \text{Equation (110)}$$

Finally, the humidity value $RH_{dev}$ of the two-component developer is obtained based on the calculation value of the relative humidity $rh_{developing}$ and the relative humidity $rh_{hopper}$, and the like, and the image forming conditions are set based on the value.

The humidity value $RH_{dev}$ (RH %) of the two-component developer within the development device 1 is calculated based on the following Equations (11) and (12). That is, $$RHp_{dev} = (RHm_{dev} - rh_{developing}) \times \exp(-(tn_{dev} - tm_{dev})/\beta_{dev}) + rh_{developing} \quad \text{Equation (11)}$$

$$RH_{dev} = RHp_{dev} + \gamma \times (RH_{hpr} - RHp_{dev}) \times \Delta x \quad \text{Equation (12)}$$

The parameters used in the equation are given below.

$RHm_{dev}$: The previous calculation value (RH %) of $RH_{dev}$ $RHp_{dev}$: The calculation value (RH %) indicating the humidity changed by the humidity adjustment of the development device 1 during the change from the $RHm_{dev}$ to the $RH_{dev}$ $tn_{dev}$: The time (min) when the current humidity is calculated $tm_{dev}$: The time (min) when the previous $RHm_{dev}$ is calculated $rh_{developing}$: The relative humidity (RH %) around the development device 1 at the time of the time $tn_{dev}$ $\beta_{dev}$: As the humidity adjustment time constant of the development device 1, the value is converted by the presence and absence of the driving of the image forming apparatus and the value is set to be the humidity adjustment time constant βi=30 min when there is the driving and the humidity adjustment time constant βo=600 min when there is no driving $RH_{hpr}$: The relative humidity (RH %) of the toner within the hopper 8 at the time of the time $tn_{dev}$ Δx: The toner weight g replenished to the development device 1 from the time $tm_{dev}$ to the time $tn_{dev}$ γ: The coefficient (RH %/g) indicating the degree of the change in humidity of the two-component developer due to the toner consumption and replenishment The amount of the two-component developer is an amount determined by the easiness of the moisture absorbing of the toner and the carrier, and the like, and is set to be 0.001 (RH %/g) obtained through an experiment in the embodiment.

The reason why the time constant $\beta_{dev}$ is converted by the presence and absence of the driving of the image forming apparatus is that it can be understood according to the reviewing of the present inventors that the rate at which the developer is familiar with the surrounding environment is different according to the driving state of the development device 1. Further, by using the coefficient γ, the effect represents the phenomenon that the humidity of the two-component developer is largely affected by the replenished toner, when the difference between the humidity of the two-component developer and the humidity of the replenished toner is large and when the total adhesion amount of the toner of the formed toner image is large.

Next, a method for obtaining the humidity value $RH_{hpr}$ of the toner within the hopper 8 will be described below. The behavior of the humidity value $RH_{hpr}$ of the toner within the hopper 8 is assumed to be the same as the left region of the dashed line L of the first embodiment of the present invention. Further, in the first embodiment of the present invention, corresponding to the air introduced from the developing sleeve 3 side is assumed to be the air on the upper part of the powdered face of the toner within the hopper 8 and the air introduced from the toner outlet of the hopper 8 into the part opened in the development device 1. In addition, the relative humidity of the air is assumed to be the $rh_{hopper}$.

That is, the humidity value $RH_{hpr}$ of the toner within the hopper 8 is as follows.

$$RHp_{hpr} = (RHm_{hpr} - rh_{hopper}) \times \exp(-(tn_{hpr} - tm_{hpr})/\beta_{hpr}) + rh_{hopper} \quad \text{Equation (13)}$$

$$RH_{hpr} = RHp_{hpr} \times (V_{hpr} - \Delta y)/V_{hpr} + RH_{btl} \times \Delta y/V_{hpr} \quad \text{Equation (14)}$$

The parameters used in the equation are given below.

$RHm_{hpr}$: The previous calculation value (RH %) of $RH_{hpr}$ $RHp_{hpr}$: The calculation value (RH %) indicating the humidity changed by the humidity adjustment of the hopper 8 during the change from the $RHm_{hpr}$ to the $RH_{hpr}$ $RH_{btl}$: The relative humidity (RH %) of the toner within the toner bottle 7, which is calculated by the following Equation 15

$tn_{hpr}$: The time (min) when the current humidity is calculated $tm_{hpr}$: The time (min) when the previous $RHm_{hpr}$ is calculated $rh_{hopper}$: The relative humidity (RH %) around the hopper 8 at the time of the time $tn_{hpr}$ $\beta_{hpr}$: The humidity adjustment time constant (min) of the hopper 8

$V_{hpr}$: The toner capacity g of the hopper 8

Δy: The toner weight g discharged and introduced from and into the hopper 8 from the time $tm_{hpr}$ to the time $tn_{hpr}$ In order to obtain the $RH_{btl}$, basically, the same calculation method as the method of being used in the development device 1 according to the first embodiment of the present invention may be used. In detail, even in the toner bottle 7, two calculation regions that are called the left and right of the dashed line L may be assumed. Here, in the image forming apparatus using the hopper 8 according to the embodiment, it is to be noted that the calculation region called the hopper 8 is created in advance.

In addition, it is based on the fact that the method for obtaining the humidity value $RH_{Lleft}$ of the toner in the left region of the dashed line L according to the first embodiment of the present invention is similar to the method for obtaining the humidity value $RH_{hpr}$ of the toner of the hopper 8. Therefore, it can be appreciated that they are arranged and can be processed by a single Equation. In this case, calculation is performed by including the predetermined volume of the outlet side of the hopper in the toner capacity $V_{hpr}$ of the hopper 8. Therefore, the humidity may be calculated based on Equation meeting the actual developing.

In detail, in Equation 13, $\beta_{hpr}$: The humidity adjustment time constant of the region in which the hopper 8 and the outlet side of the toner bottle 7 are combined.

In the embodiment, the humidity adjustment time constant is constant as $\beta_{hpr}$=300 (min).

Further, in Equation 14, $V_{hpr}$: The toner capacity (g) of the region in which the hopper 8 and the outlet side of the toner bottle 7 are combined. In the embodiment, Vhpr=400 (g) as 200 (g) of the part of the hopper 8+200 (g) of the part of the toner bottle 7.

Figure 10:
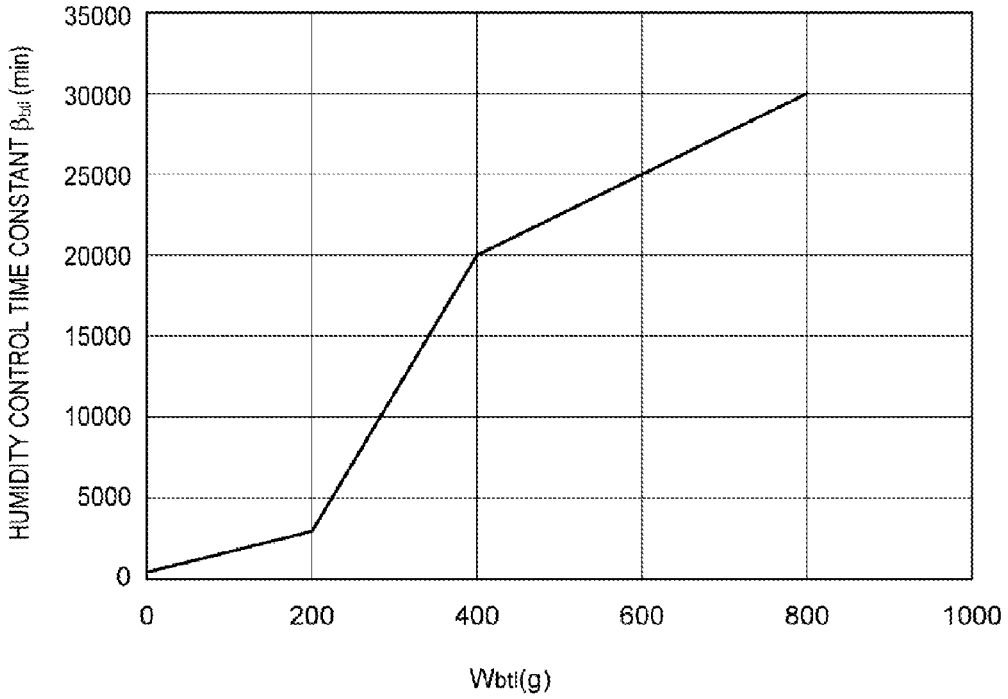
FIG. 10 is a graph illustrating a relationship between a residual amount of a toner within a toner bottle according to the second embodiment of the present invention and a humidity adjustment time constant.

Further, the feature portion in the embodiment corresponds to a part of which the humidity value $RH_{btl}$ of the toner within the toner bottle 7 is obtained. FIG. 10 is a graph illustrating a relationship between the residual quantity of the toner of the toner bottle according to the second embodiment of the present invention and the humidity adjustment time constant. The vertical axis indicates the humidity adjustment time constant $\beta_{btl}$ and the horizontal axis indicates the residual amount $W_{btl}$ of the toner.

As illustrated in FIG. 10, when the residual amount $W_{btl}$ of the toner is large, the humidity adjustment time constant $\beta_{btl}$ is also large and it is difficult to progress the humidity adjustment. To the contrary, when the residual amount $W_{btl}$ of the toner is small, the humidity adjustment time constant $\beta_{btl}$ is reduced and it is easy to progress the humidity adjustment.

Further, in the case of the embodiment, it is different from W of the first embodiment and the $W_{btl}$ is a value in which the outlet side of the toner bottle 7 is excluded as an object. For this reason, there is no need to differentiate the graph due to the different points of the residual amount $W_{btl}$ of the toner.

Defining the humidity adjustment time constant $\beta_{btl}$ as described above, the humidity value $RH_{btl}$ is obtained by the following Equation.

$$RH_{btl}=(RHm_{btl}-RHm_{hpr})\times\exp(-(tn_{btl}-tm_{btl})/\beta_{btl})+RHm_{hpr} \quad \text{Equation (15)}$$

That is, the humidity information $RHm_{btl}$ of the toner within the toner bottle 7 acquired based on the detection result of the temperature and humidity sensor 51 and the hopper temperature sensor 53 and the current humidity information $RH_{btl}$ of the toner within the toner bottle 7 changed by the humidity adjustment based on the time information $tn_{btl}$ and $tm_{btl}$ detecting the humidity information are calculated.

The parameter used in the equation is given below.

$RHm_{btl}$: The calculation value (RH %) of the previous $RH_{btl}$

The initial value is a value (50%) at the time of the factory releasing.

Further, the value to the initial value is returned at a timing when the toner bottle 7 is exchanged with a new product, that is, when the toner bottle 7 of the new product in the sealed state is opened.

The parameters used in the equation are also given below.

$tn_{btl}$: The time (min) when the current humidity is calculated $tm_{btl}$: The time (min) when the previous $RHm_{btl}$ is calculated $\beta_{btl}$: The humidity adjustment time constant (min) in the right region of the dashed line L $W_{btl}$: The toner amount (g), 0 to 800 (g) in the right region of the dashed line L In the Equation (15), the $RH_{hpr}$ is originally disposed in the term of the $RHm_{hpr}$, but in Equation (3), similar to the case of $RH_{Lright}\approx RHm_{Lright}$, it is calculated as $RH_{hpr}\approx RHm_{hpr}$.

Based on the foregoing description, finally, the image forming conditions may be appropriately set according to the value of the humidity $RH_{dev}$ of the two-component developer. In addition, the problem of the change of the image density may be solved by accurately figuring out the humidity of the replenished toner that is not figured out by the related art.

The embodiment exhibits the effect when the consumption amount of the toner per one sheet of the formation image is large, as can be appreciated from Equation 12. Further, since a maximum value of the humidity adjustment time constant $\beta_{btl}$ becomes 35,000 (min), the embodiment in particular exhibits the effect in the case of the high output frequency, such as the case in which the toner of about 800 g are used up before and after 35,000 min, that is, in several days to several tens of days.

There may be a case in which the calculation in Equations 13 to 15 may be more simplified. First, when the toner capacity of the toner bottle 7 is a predetermined value (for example, 1,000 g or more) and is a high print amount entirely used before the humidity adjustment of the toner is made, the humidity of the toner depending on Equation 15 may be constant from the releasing.

In the embodiment, the control of the image forming apparatus will be described in more detail and for this reason, the parameter determining the image forming conditions is present in plural. The example is the presence and absence of the driving of the development device 1 or the toner weight Δx (toner amount) replenished to the development device 1.

For example, reviewing Equation 12, the humidity value $RH_{dev}$ is changed according to a large and small of only the Δx. For this reason, actually, the humidity adjustment rate is not necessarily determined only by the residual amount of the toner within the toner bottle. For this reason, the image forming condition is not uniquely determined only from the residual amount of the toner within the bottle. However, when the condition other than the residual amount of the toner within the toner bottle is the same condition, the large and small relationship of the changed amount of the image forming conditions is uniquely determined according to the large and small relationship of the residual amount of the toner within the bottle.

In the two-component phenomenon type, when the charging amount of the toner is slowly increased, the phenomenon that the electric field by the developing bias is mainly weakened by the electric field leading to the toner layer on the photosensitive drum 28 occurs. For this reason, even in the embodiment, similar to the first embodiment, the Vcont is set to be large under the low-humidity environment and the Vcont is set to be small under the high-humidity environment. Therefore, the adjustment is made so that the toner adhesion amount is constant. During the process of determining the charging amount according to the image formation from the humidity, the image forming conditions may be determined using the graph having the same shape as the graph illustrated in FIG. 5 of the first embodiment of the present invention. Herein, the value is slightly changed due to the difference in the type or the color, but the graph is approximately the same, and therefore the description thereof will be omitted in the embodiment.

Figure 11:
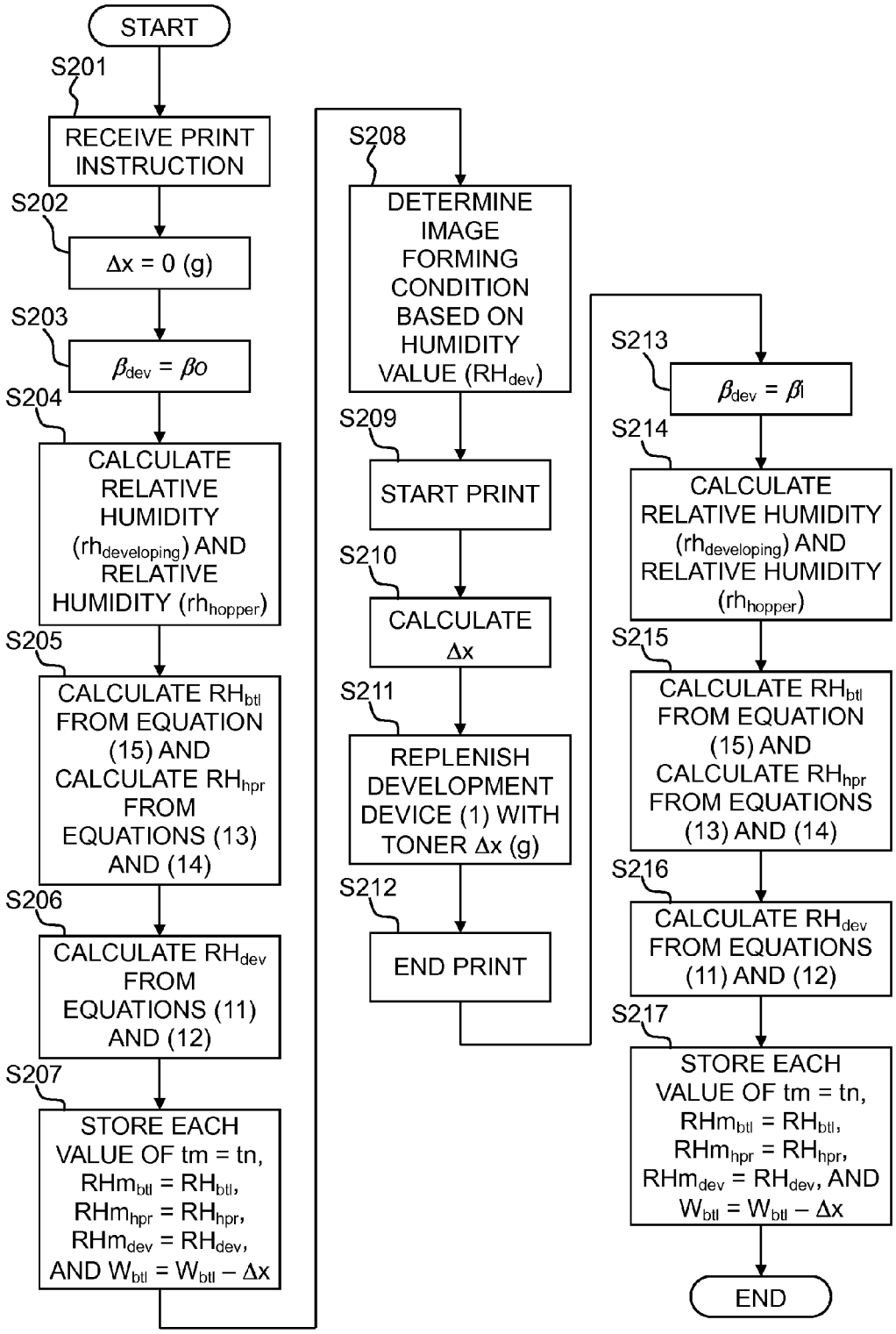
FIG. 11 is a flow chart describing a printer control according to the second embodiment of the present invention.

The detailed operation of the printer controller 300 will be described with reference to the flow chart of FIG. 11. FIG. 11 is a flow chart describing a printer control according to the second embodiment of the present invention. The present flow is processed in parallel with each station of Y, M, C, and K illustrated in FIG. 7, but for simplification, the specific station will be described.

Further, for simplification of description, in connection with each calculation time, $tn_{dev}=tn_{hpr}=tn_{btl}=tn$ and further, in connection with each storage time, $tm_{dev}=tm_{hpr}=tm_{btl}=tm$. In the actual operation, considering the resource of the CPU 301, each calculation time and each storage time are each performed at independent timing and for the development device 1, is performed at a high frequency and for others, is performed at a low frequency.

Further, Δx and Δy may be originally different values at the same time, but since the front and back of the finally moving toner amount match each other, for simplification of description, Δy=Δx.

As illustrated in FIG. 11, when the printer controller 300 receives the print instruction (step S201), first Δx=0 (g) (step S202). The reason is that when the previous calculation corresponds to the case in which the previous print operation ends, the replenishment, consumption, and the like, of the toner do not occur from the timing till the print instruction this time. In addition, the humidity adjustment time constant $\beta_{dev}$ is set to be βo (step S203). There is no driving of the development device from the timing when the previous print operation ends.

The printer controller 300 reads the required value from the non-volatile RAM 303 to perform the calculation of the relative humidity $rh_{developing}$ and the relative humidity $rh_{hopper}$ that are the feature portion of the embodiment, based on Equations 109 and 110 (step S204).

Although the sequence is reverse to the above description, in the present flow, first, the $RH_{btl}$ is obtained from Equation 15 and the $RH_{hpr}$ is obtained from Equations 13 and 14 (step S205). In addition, the $RH_{dev}$ is calculated from Equations 11 and 12 (S206). Herein, the printer controller 300 stores the value used in the calculation and the calculated value in the non-volatile RAM 303 (step S207).

Next, the printer controller 300 determines the values of the Vchg (V) and Vdev (V) that are the image forming conditions based on the $RH_{dev}$ obtained in step S206 (step S208) and starts the print operation based on the value (step S209). During the print operation, similar to Δz in the first embodiment of the present invention, the printer controller 300 acquires the total sum data Σ of the exposure amount from the laser controller 200 and calculates the replenished toner weight Δx (step S210). The toner is replenished to the development device 1 from the hopper 8 based on the Δx (step S211).

When the print operation ends (step S212), one calculated in the next calculation is the change in humidity of the period for which the print operation is performed, that is, the period for which the development device 1 is driven. For this reason, the humidity adjustment time constant $\beta_{dev}$ is set to be βi (step S213). Next, the calculation of the relative humidity $rh_{developing}$ and the relative humidity $rh_{hopper}$ is performed (step S214) and after the $RH_{btl}$ is obtained from the above Equation 15, the $RH_{hpr}$ is obtained from the following Equations 13 and 14 (step S215). Further, the $RH_{dev}$ is calculated from the above Equations 11 and 12 after the development device 1 is driven (step S216). Finally, the printer controller 300 stores the value used in the calculation and the calculated value (step S217) so as to be included for the next image formation.

As described above, the printer controller 300 sets the changed amount of the parameter about the image density to the change in humidity to be small when the residual amount of the toner of the replenishment toner tank (toner bottle 7 or hopper 8) is large. Meanwhile, the changed amount of the parameter is set to be large when the residual amount of the toner of the replenishment toner tank is small.

Further, the printer controller 300 sets the changed amount of the parameter about the image density to the change in humidity to be large when the toner amount replenished from the replenishment toner tank to the development device is large and to be small when the toner amount replenished from the replenishment toner tank to the development device is small. In other words, when the Vcont as the parameter about the image density is changed in response to the change in humidity of the body atmosphere, the Vcont is controlled based on the above Equation (15). For this reason, compared with the case in which the residual amount of the toner within the replenishment toner tank is large, in the case in which the residual amount of the toner is small, the changed amount of the Vcont to the change in humidity per unit time is increased.

As described above, when the humidity is changed, the high quality of toner image may be formed by appropriately setting the image forming conditions.

Third Embodiment

The schematic configuration of image forming apparatus according to the third embodiment of the present invention is approximately the same as the configuration of the second embodiment. The same components as described above are denoted by the same reference numerals, and therefore, the description thereof will be omitted.

However, the embodiment has the following features. That is, the density gradation control is performed by a γ lookup table. Next, Δx is obtained from the measuring screw driving signal, rather than the exposure amount. Finally, the time constant $\beta_{dev}$ is converted by the presence and absence of the driving of the development device 1 rather than by the presence and absence of the driving of the image forming apparatus.

Figure 12:
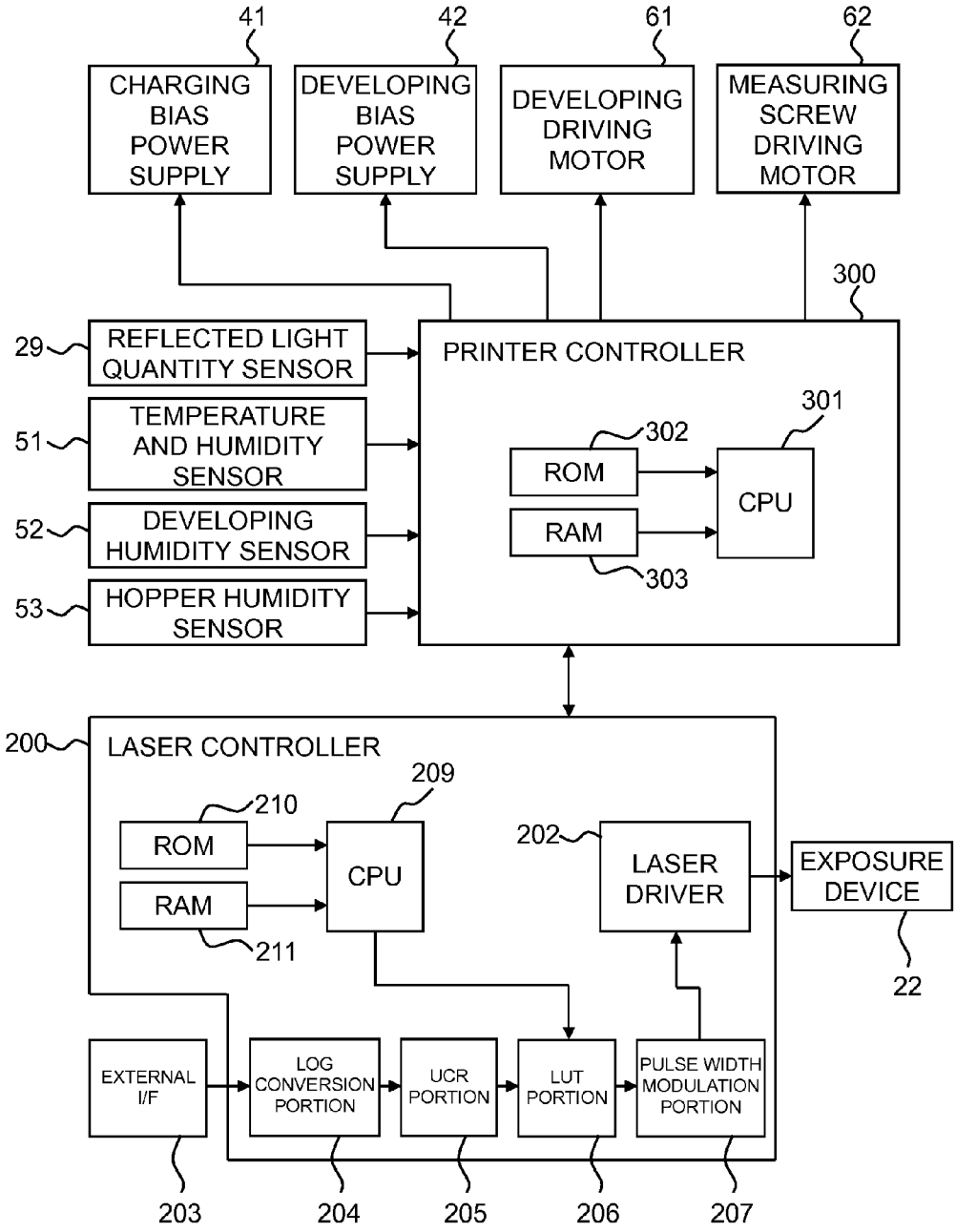
FIG. 12 is a control block diagram for forming an image according to a third embodiment of the present invention.

FIG. 12 is a control block diagram for forming an image according to a third embodiment of the present invention. The laser controller 200 and the γ lookup table will be described in detail with reference to FIG. 12.

First, color image data is input to the laser controller 200 as RGB image data via an external input interface 203 (external I/F). As the external input interface 203, there is an external apparatus such as an original scanner and a computer (information processing apparatus), but any device may be used.

A LOG conversion portion 204 converts luminance data of the input RGB image data into density data (CMY image data) of CMY based on the table stored in the ROM 210. A masking UCR portion 205 extracts black (K) component data from the CMY image data and performs a matrix calculation on the CMY image data so as to correct color cloudiness of a recording color material and forms the CMY image data as the YMCK image data.

A LUT portion 206 uses a γLUT (γ lookup table) so as to match the image data with the ideal gradation characteristics of the printer portion and performs the density correction for each color of the input YMCK image data. The γLUT is calculated so as to be linearly supplemented by the humidity value $RH_{dev}$ of the developer from the table data each corresponding to the humidity value $RH_{dev}$ of the developer of the finite number (7 value in the embodiment) stored in the ROM 210. The γLUT is set in the LUT portion 206 by the CPU 209.

A pulse width modulation portion 207 outputs a pulse signal of a pulse width corresponding to a level of the image data (image signal) input from the LUT portion 206. A laser driver 202 is driven to change a total light emitting time of a laser of the exposure device 22 based on the pulse signal. By doing so, the laser irradiated from the exposure device 22 exposes the Vd (V) portion on the photosensitive drum 28. As described above, the γLUT is prepared and used by the humidity value $RH_{dev}$ of the developer, such that the image formation may be stably performed with a half tone or a density of a highlight portion as well as a high density portion.

In the embodiment, a method for determining the replenished amount of the toner corresponding to the amount consumed by detecting the developing capability of the two-component developer is used. In detail, the printer controller 300 forms a reference electrostatic latent image on the photosensitive drum 28 and develops the reference electrostatic latent image so as to be formed as the reference toner image and detects the reflection light quantity on the reference toner image by reflection light quantity sensors 29 mounted on the intermediate transfer belt 24 to face each other. Further, the replenished amount of the toner is determined by comparing with a reference value.

Next, the illustrated measuring screw driving motor 62 is driven based on the value to rotate the measuring screw 9 (toner measuring replenishment member) illustrated in FIG. 8 and replenishes the developing container 2 of the development device 1 with the toner. In the embodiment, the toner weight Δx replenished using the driving time of the measuring screw driving motor 62 is calculated.

Further, in the second embodiment, for simplifying of description, the time constant $\beta_{dev}$ that is based on the presence and absence of the driving of the image forming apparatus is based on the presence and absence of the driving of the development device 1 in the embodiment.

The developing driving motor 61 drives the developing sleeve 3 and the agitating member 6 of the development device 1. The presence and absence of the driving of the developing driving motor 61 is controlled by the printer controller 300. Therefore, in addition to improving the precision of the calculation of the humidity value $RH_{dev}$, when the image forming apparatus outputs a K monochromatic image, the humidity values $RH_{dev}$ of each color of YMCK may be calculated with high precision even when the development device 1 of the YMC stops.

Figure 13:
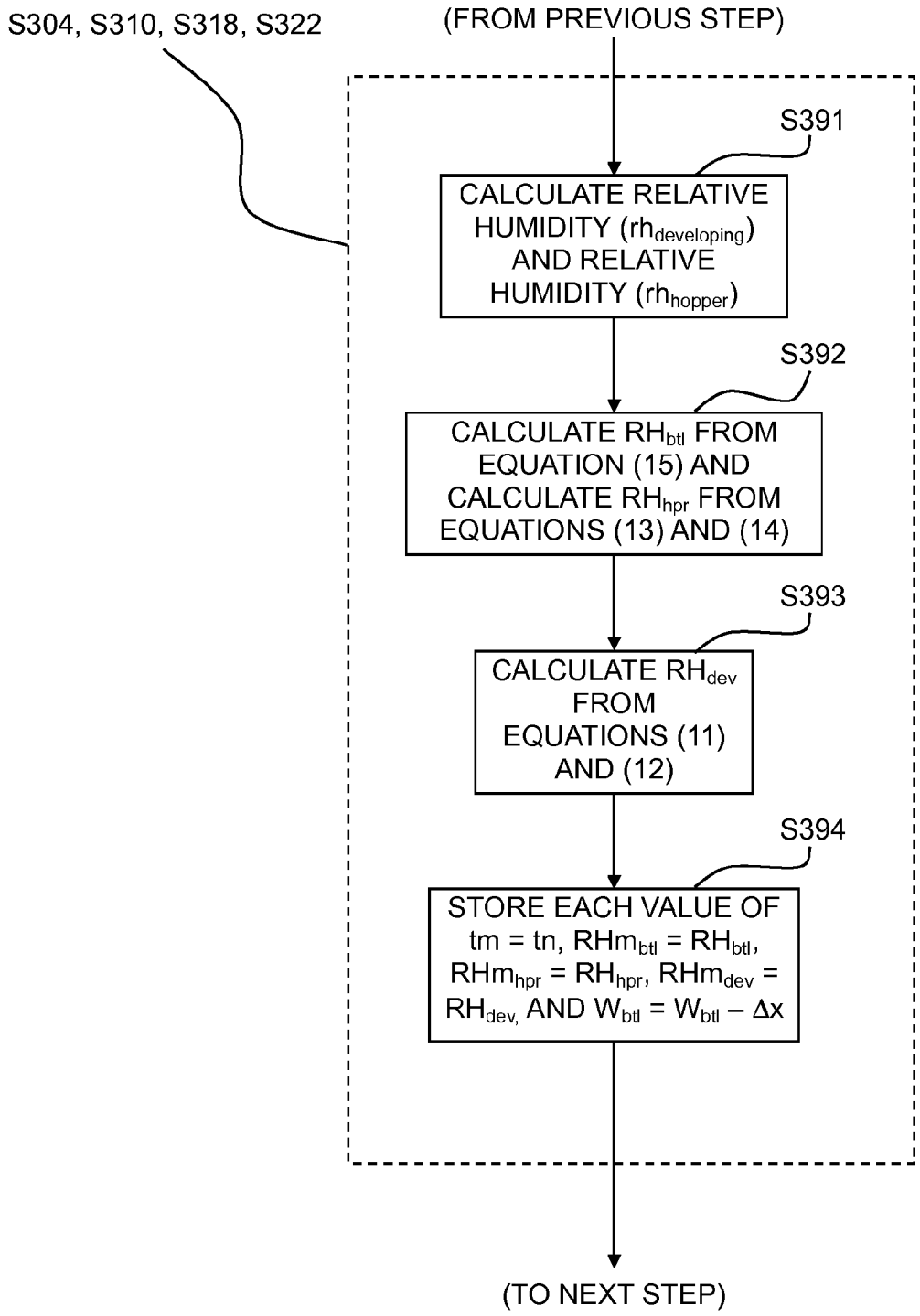
FIG. 13 is a flow chart describing common parts of a printer controller according to the third embodiment of the present invention.
Figure 14:
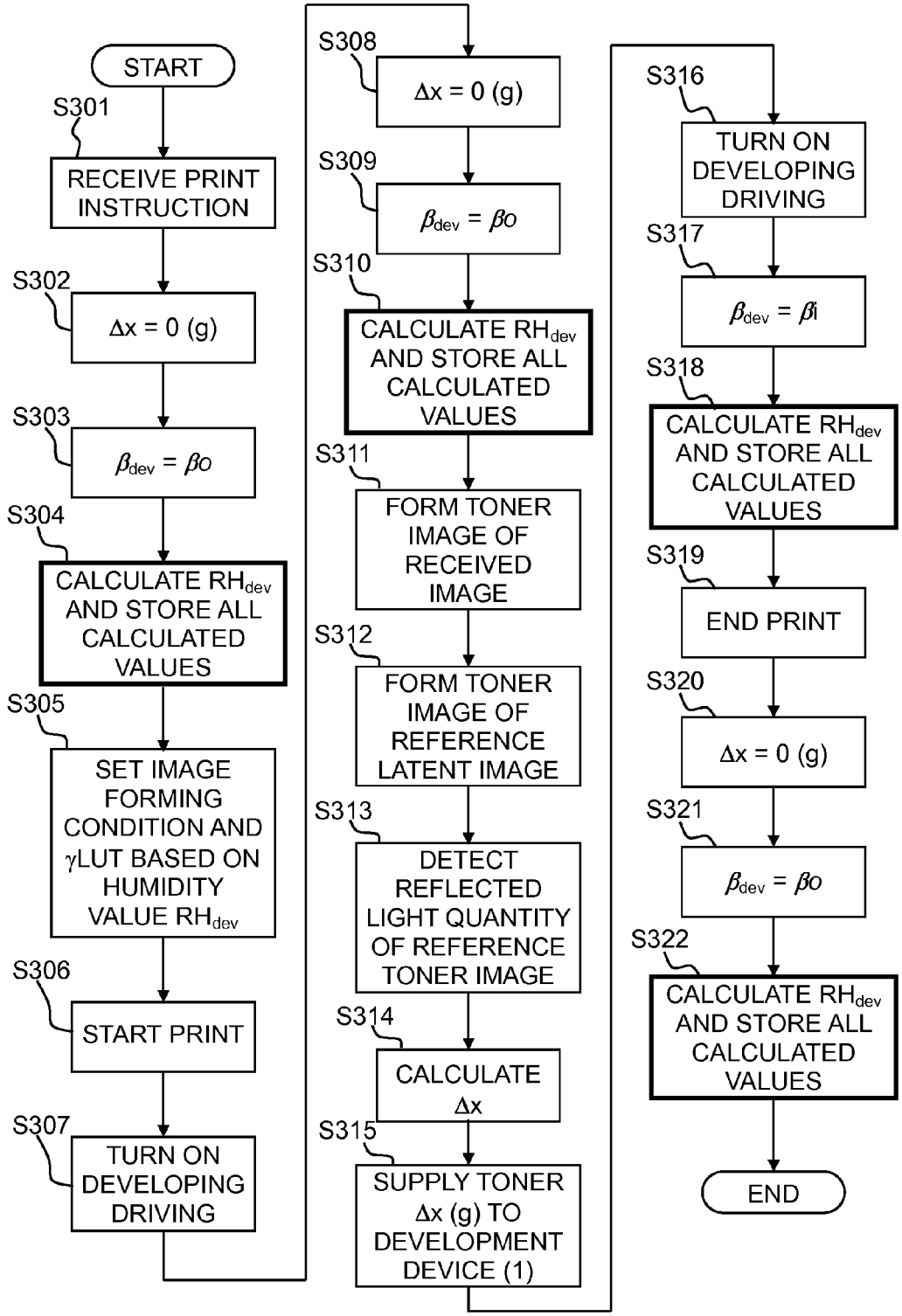
FIG. 14 is a flow chart describing the overall printer controller according to the third embodiment of the present invention.

The operation of the image forming apparatus according to the embodiment will be described in detail with reference to the flow charts of FIGS. 13 and 14. FIG. 13 is a flow chart describing common parts of a printer controller according to the third embodiment of the present invention. FIG. 14 is a flow chart describing the overall printer controller according to the third embodiment of the present invention.

First, the flow illustrated as steps S391 to S394 in FIG. 13 shows the same operation as steps S204 to S207 of the flow chart of FIG. 11 according to the second embodiment of the present invention and is a process of calculating the humidity value $RH_{dev}$ and storing the humidity value. This is used in common as steps S304, S310, S318, and S322 in the flow chart illustrated in FIG. 14.

In FIG. 14, when the printer controller 300 receives the print instruction (step S301), first, Δx=0 (g) (step S302). The reason is that the measuring screw driving motor 62 is not driven from the previous image formation to the present time.

Further, the developing driving motor 61 is not driven from the previous image formation to the present time, and therefore the humidity adjustment time constant $\beta_{dev}$ is set to be βo (step S303). Under the conditions, the printer controller 300 performs the operations of steps S391 to S394 of FIG. 13 and obtains the current humidity value $RH_{dev}$ of the developer (step S304).

As the humidity value $RH_{dev}$ is obtained, the printer controller 300 sets the image forming condition based on the value. The laser controller 200 sets the γLUT (step S305) and then the print operation starts (step S306).

From the start of the print operation to the driving of the development device 1, the time may be created in a unit of several tens of seconds or more by the processing within the laser controller 200 according to the size of the image data. For this reason, the printer controller 300 calculates the change in humidity according to the lapse of time from S304 when the driving of the developing driving motor 61 starts (driving on) (step S307).

In detail, Δx=0 (S308). After $\beta_{dev}$=βo (step S309), similar to S304, the humidity value $RH_{dev}$ of the developer of the state just before the development device 1 is driven is obtained by the foregoing process of FIG. 13 (step S310).

The printer controller 300 continuously performs the toner image formation of the received image (step S311). Next, the reference toner image is formed (step S312) and the reflection light quantity is detected by the reflection light quantity sensor 29 (step S313) to obtain the replenished toner weight Δx (step S314). The printer controller 300 drives the measuring screw driving motor 62 based on the Δx and replenishes the development device 1 with the toner of the toner weight Δx (g) (step S315).

The replenished toner is more preferably mixed with the two-component developer in the development device 1 in the driven state, rather than in the development device 1 in the stopping state. For this reason, the printer controller 300 ends the toner replenishment operation of S315 and then turns off the driving of the developing driving motor 61 (step S316). Herein, the printer controller 300 obtains the humidity value $RH_{dev}$ of the developer by the foregoing process of FIG. 13 as the humidity adjustment time constant $\beta_{dev}$=βi (step S317) so as to calculate the change in humidity during the driving of the development device 1 (step S318).

After the development device 1 stops, the standby time until the output image passes through the fixing device 25 or the standby time when any adjustment and cleaning operation enter the image forming apparatus is generated. For this reason, the change in humidity from the timing of S318 to the print ending (S319) is calculated. In detail, as Δx=0 (step S320) and $\beta_{dev}$=βo (step S321), the humidity value $RH_{dev}$ of the developer is obtained (step S322) and the next print is prepared.

As described above, the present invention describes three embodiments by way of example, but is not limited to these types. For example, the image forming conditions reflecting the $RH_{dev}$ may include the exposure intensity of the laser irradiated from the exposure device 22, the developing bias (in particular, AC component) or the transfer condition, and the like. In addition, it may be configured to control the driving of the developing sleeve 3 and the agitating member 6, independent from the body of the image forming apparatus. Further, the temperature information of the development device 1 and the hopper 8 may be expected from the operation state of the image forming apparatus.

By the configuration described above, when the humidity is changed, the high quality of toner image may be formed by appropriately setting the image forming conditions.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2012-103583, filed Apr. 27, 2012, which is hereby incorporated by reference herein in its entirety.

What is claimed is:

1. An image forming apparatus, comprising:

an image bearing member;

a development device which contains toner and develops a latent image on the image bearing member as a toner image;

an acquisition portion that acquires information about a residual amount of toner contained in the development device;

a main body humidity sensor which detects information about atmosphere humidity of a main body of the image forming apparatus;

a main body temperature sensor which detects information about temperature of the main body of the image forming apparatus;

a calculating portion which calculates toner humidity information regarding a humidity of the toner in the development device based on detected information from the main body humidity sensor and the main body temperature sensor and time information for the detections; and a controlling portion which controls a developing contrast based on the toner humidity information calculated by the calculating portion, wherein the calculating portion calculates the toner humidity information based on last-calculated toner humidity information calculated by the calculating portion, time information regarding the last-calculated toner humidity information, humidity information currently obtained from detected information from the main body humidity sensor and the main body temperature sensor, time information regarding the humidity information currently detected and a time constant set based on the residual amount of the toner, and wherein in a case that the residual amount of the toner is greater than or equal to a predetermined value, the controlling portion sets the time constant at a first time constant, and in a case that the residual amount of the toner is less than the predetermined value, the controlling portion sets the time constant at a second time constant which is less than the first time constant.

2. The image forming apparatus according to claim 1, wherein the calculating portion calculates the toner humidity information based on a value by shifting the last-calculated toner humidity information toward the humidity information according to the time constant.

3. The image forming apparatus according to claim 1, wherein the development device contains a toner-bearing body configured to be rotated and develop a latent image formed on the image bearing member, and the toner humidity information includes first toner humidity information regarding a humidity of the toner in the development device at a first area, and second toner humidity information regarding a humidity of the toner in the development device at a second area, and the controlling portion controls the developing contrast based on the first toner humidity information.

4. The image forming apparatus according to claim 3, wherein the calculating portion calculates the first toner humidity information and the second toner humidity information based on last-calculated first toner humidity information, last-calculated second toner humidity information, time information regarding the last-calculated first toner humidity information and the last-calculated second humidity information, the humidity information currently obtained from detected information from the main body humidity sensor and the main body temperature sensor, the time information regarding the humidity information and the time constant set based on a residual amount of the toner.

5. An image forming apparatus, comprising:

an image bearing member;

a development device which contains toner and develops a latent image on the image bearing member as a toner image;

a toner bottle which stores toner;

a hopper which temporarily stores the toner discharged from the toner bottle, the hopper configured to supply the toner stored inside toward the development device;

an acquisition portion which acquires information regarding a residual amount of toner in the toner bottle;

a main body humidity sensor which detects information about atmosphere humidity of a main body of the image forming apparatus;

a main body temperature sensor which detects information about temperature of the main body of the image forming apparatus;

a calculating portion which calculates first toner humidity information regarding a humidity of the toner in the development device, second toner humidity information regarding a humidity of the toner in the hopper, and third toner humidity information regarding a humidity of the toner in the toner bottle; and a controlling portion which controls a developing contrast based on the first toner humidity information, the second toner humidity information, the third humidity information, and a toner supply value supplied from the hopper to the development device;

wherein the calculating portion calculates the third toner humidity information based on last-calculated second toner humidity information, last-calculated third toner humidity information, time information regarding to the last-calculated third toner humidity information, time information regarding currently calculated third toner humidity information, and a time constant set according to the residual amount of the toner, and wherein in a case that the residual amount of the toner is greater than or equal to a predetermined value, the controlling portion sets the time constant at a first time constant, and in a case that the residual amount of the toner is less than the predetermined value, the controlling portion sets the time constant at a second time constant which is less than the first time constant.

6. The image forming apparatus according to claim 5, wherein the calculating portion calculates the third toner humidity information based on a value by shifting the last-calculated second toner humidity information toward the last-calculated third toner humidity information according to the time constant.

7. The image forming apparatus according to claim 5, further comprising:

a first temperature sensor which detects an atmosphere temperature in the development device; and a second temperature sensor which detects atmosphere temperature in the hopper, wherein the calculating portion calculates the first toner humidity information based on first detecting results from the main body humidity sensor, the main body temperature sensor, and the first temperature sensor, and time information regarding the first detecting results, and the calculating portion calculates the second toner humidity information and the third toner humidity information based on second detecting results from the main body humidity sensor, the main body temperature sensor, and the second temperature sensor, and time information regarding the second detecting results.

8. An image forming apparatus, comprising:

an image bearing member;

a development device which contains toner and develops a latent image on the image bearing member as a toner image;

an acquisition portion that acquires information about a residual amount of toner contained in the development device;

a main body humidity sensor which detects information about atmosphere humidity of a main body of the image forming apparatus;

a main body temperature sensor which detects information about temperature of the main body of the image forming apparatus; and a controlling portion which controls a developing contrast based on first detecting results of the main body humidity sensor and the main body temperature sensor at a first time, first time information regarding the first detecting results, second detecting results of the main body humidity sensor and the main body temperature sensor at a second time, a second time information regarding the second detecting results and the information acquired by the acquisition portion, wherein a changing amount of the developing contrast to the change in humidity per unit time at a first case is greater than a changing amount of the developing contrast to the change in humidity per unit time at a second case, the first case being that the residual amount of the toner is less than a predetermined value and the second case being that the residual amount of the toner is greater than the predetermined value.

9. An image forming apparatus, comprising:

an image bearing member;

a development device which contains toner and develops a latent image on the image bearing member as a toner image;

a toner bottle which stores toner and is configured to supply the toner to the development device;

an acquisition portion which acquires information regarding a residual amount of toner in the toner bottle;

a main body humidity sensor which detects information about atmosphere humidity of a main body of the image forming apparatus;

a main body temperature sensor which detects information about temperature of the main body of the image forming apparatus; and a controlling portion which controls a developing contrast based on first detecting results of the main body humidity sensor and the main body temperature sensor at a first time, first time information regarding the first detecting results, second detecting results of the main body humidity sensor and the main body temperature sensor at a second time, second time information regarding the second detecting results and the information acquired by the acquisition portion, wherein a changing amount of the developing contrast to the change in humidity per unit time at a first case is greater than a changing amount of the developing contrast to the change in humidity per unit time at a second case, the first case being that the residual amount of the toner is less than a predetermined value and the second case being that the residual amount of the toner is greater than the predetermined value.

* * * * *